US011214979B2

(12) United States Patent
Huang et al.

(10) Patent No.: US 11,214,979 B2
(45) Date of Patent: Jan. 4, 2022

(54) LOCK, METHOD FOR DISMOUNTING LOCK AND METHOD FOR MOUNTING LOCK

(71) Applicant: TAIWAN FU HSING INDUSTRIAL CO., LTD., Kaohsiung (TW)

(72) Inventors: Lien-Hsi Huang, Kaohsiung (TW); Yu-Cheng Lin, Tainan (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 16/561,021

(22) Filed: Sep. 5, 2019

(65) Prior Publication Data

US 2020/0190849 A1 Jun. 18, 2020

(30) Foreign Application Priority Data

Dec. 12, 2018 (TW) ..... 107216876
Jul. 22, 2019 (TW) ..... 108125758

(51) Int. Cl.
*E05B 9/08* (2006.01)
*B25B 15/02* (2006.01)
*B25B 15/00* (2006.01)

(52) U.S. Cl.
CPC ..... *E05B 9/08* (2013.01); *B25B 15/005* (2013.01); *B25B 15/02* (2013.01)

(58) Field of Classification Search
CPC ..... E05B 9/08; E05B 17/0004; E05B 3/00; Y10T 70/5832; Y10T 292/91; Y10T 292/57

(Continued)

(56) References Cited

U.S. PATENT DOCUMENTS 4,672,829 A * 6/1987 Gater ..... E05B 55/005 70/224
4,869,083 A * 9/1989 DeMarseilles ..... E05B 55/005 70/224

(Continued)

FOREIGN PATENT DOCUMENTS

CN 1103697 A 6/1995
CN 1243189 A 2/2000

(Continued)

OTHER PUBLICATIONS

Lien-Hsi Huang, Title of Invention: Fixing Structure for Lock, and Lock Therewith, U.S. Appl. No. 16/561,022, filed Sep. 5, 2019.

*Primary Examiner* — Jacob J Cigna
*Assistant Examiner* — Michael W Hotchkiss
(74) *Attorney, Agent, or Firm* — Winston Hsu

(57) ABSTRACT

A lock defining a rotating axis and being installed on a door includes a mounting plate, a fastening member and a first handle set. The mounting plate is disposed on a side of the door and includes a mounting plate body and a protruding lug connected to the mounting plate body. The mounting plate body includes a locking slot structure. The protruding lug includes a fastening hole. The fastening member is inserted through the fastening hole of the protruding lug to fix the mounting plate on the door. The first handle set is assembled on the mounting plate. The first handle set includes an engaging structure and a decoration cover. The engaging structure is engaged with the locking slot structure to fix the first handle set on the mounting plate. The decoration cover covers the mounting plate and includes an opening corresponding to the fastening hole.

6 Claims, 27 Drawing Sheets

(58) Field of Classification Search
USPC ..... 70/224
See application file for complete search history.

(56) References Cited

U.S. PATENT DOCUMENTS 5,265,924 A * 11/1993 Kim ..... E05B 3/065 292/336.3
5,317,889 A * 6/1994 Solovieff ..... E05B 9/086 70/224
5,598,726 A * 2/1997 Cordle ..... E05B 55/005 292/336.3
5,712,626 A * 1/1998 Andreou ..... E05B 47/0661 340/5.67
5,732,578 A * 3/1998 Kang ..... E05B 3/065 292/336.3
5,761,936 A * 6/1998 Katayama ..... E05B 3/065 292/336.3
6,048,007 A * 4/2000 Shor ..... E05B 3/065 292/336.3
6,241,295 B1 6/2001 Hoogendoorn
6,264,255 B1 * 7/2001 Fortune ..... E05B 3/00 292/336.3
6,568,231 B1 5/2003 Huang
6,598,440 B1 * 7/2003 Armstrong ..... E05B 3/003 292/336.3
6,644,077 B1 11/2003 Huang
6,745,602 B2 * 6/2004 Nakasone ..... E05B 3/003 16/441
6,988,751 B2 * 1/2006 Fishencord ..... E05C 1/163 292/336.3
7,066,507 B2 * 6/2006 Don ..... E05B 9/08 292/169
7,311,342 B1 * 12/2007 Fan ..... E05B 15/02 292/336.3
8,360,489 B2 * 1/2013 Cho ..... E05B 3/065 292/357
8,746,760 B2 * 6/2014 Chen ..... E05B 3/065 292/357
9,267,311 B2 * 2/2016 Huang ..... E05B 15/02
10,844,633 B2 * 11/2020 Qiu ..... E05B 9/08
2002/0104345 A1 * 8/2002 Wang ..... E05B 13/101 70/472
2003/0121300 A1 * 7/2003 Wang ..... E05B 15/02 70/224
2004/0189022 A1 * 9/2004 Don ..... E05B 9/08 292/356
2005/0184538 A1 * 8/2005 Huang ..... E05B 13/004 292/336.3
2007/0096479 A1 5/2007 Lin
2011/0006550 A1 * 1/2011 Cho ..... E05B 3/065 292/167
2012/0235429 A1 * 9/2012 Chen ..... E05B 3/065 292/357
2014/0319858 A1 10/2014 Huang
2020/0318386 A1 10/2020 Huang

FOREIGN PATENT DOCUMENTS

CN 1297097 A 5/2001
CN 1068651 C 7/2001
CN 2690515 Y 4/2005
CN 201087589 Y 7/2008
CN 202039660 U 11/2011
GB 2 272 252 B 7/1996
JP 9-317286 A 12/1997
JP 2012-237121 A 12/2012
JP 5723210 B2 5/2015

* cited by examiner

LOCK, METHOD FOR DISMOUNTING LOCK AND METHOD FOR MOUNTING LOCK

BACKGROUND OF THE INVENTION

1. Field of the Invention

The present disclosure relates to a lock, a method for dismounting the lock and a method for mounting the lock, and more particularly, to a lock which is easy to mount and dismount, a method for dismounting the lock and a method for mounting the lock.

2. Description of the Prior Art

A typical door lock includes an exterior handle set, an interior handle set and a latch mechanism which are mounted to a door in an assembling manner. The latch mechanism is typically mounted on the door first. Then, the interior and exterior handle sets on both sides of the door are aligned with and connected to the latch mechanism. Afterwards, the interior and exterior handle sets are aligned with and fixedly connected to each other by screws. However, during the connecting process, a user needs to hold the interior and exterior handle sets with one hand while operating a screwdriver to screw the screws with another hand. Because the position of the interior and exterior handle sets is hard to maintain, the smoothness of operating the screwdriver of the user is affected, which causes inconvenience of mounting the door lock.

Furthermore, for enhancing the appearance of the door lock, the screws are usually covered by the decoration cover of the interior handle set or the exterior handle set. When the door lock is broken and needs to be repaired or replaced, the user has to remove the decoration cover before operating the screwdriver to unscrew the screws to dismount the interior handle set or the exterior handle set from the door. However, the necessary of repairing or replacing the door lock usually happens after the door lock has been purchased for quite a while. The user may have lost the operation manual of the door lock. Alternatively, the user may still keep the operation manual, but the user still cannot understand how to remove the decoration cover due to the limitation of the written expression. As a result, it is difficult for the user to dismount the door lock by himself/herself. Therefore, the typical door lock has drawbacks of inconvenience of mounting and dismounting.

SUMMARY OF THE INVENTION

According to an embodiment of the present disclosure, a lock defining a rotating axis and being installed on a door includes a mounting plate, a fastening member and a first handle set. The mounting plate is disposed on a side of the door. The mounting plate includes a mounting plate body and a protruding lug connected to the mounting plate body. The mounting plate body includes a locking slot structure. The protruding lug includes a fastening hole. The fastening member is inserted through the fastening hole of the protruding lug to fix the mounting plate on the door. The first handle set is assembled on the mounting plate. The first handle set includes an engaging structure and a decoration cover. The engaging structure is engaged with the locking slot structure to fix the first handle set on the mounting plate. The decoration cover covers the mounting plate. The decoration cover includes an opening corresponding to the fastening hole. The protruding lug protrudes from the mounting plate body toward the first handle set along the rotating axis. A dimension of the opening of the decoration cover is greater than a maximum radial dimension of the fastening member.

According to another embodiment of the present disclosure, a method for dismounting the aforementioned lock from the door includes steps as follows. A tool is used to unfasten the fastening member via the opening of the decoration cover such that the fastening member is no longer in a fastened state. The first handle set is moved away from the door such that the first handle set and the mounting plate are dismounted from the door.

According to yet another embodiment of the present disclosure, a method for mounting a lock on a door is disclosed. The lock includes a mounting plate and a first handle set. The mounting plate includes a locking slot structure. The first handle set includes a cover plate, a first handle and a first abutting feature. The cover plate includes an engaging structure and a second abutting structure. The first handle is rotatably connected to the cover plate. The first abutting feature is connected to the first handle in a manner that the first abutting feature is moved synchronously with the first handle. The method includes steps as follows. The mounting plate is fixed on a side of the door. The engaging structure of the cover plate is aligned with the locking slot structure of the mounting plate. The first handle is rotated such that the first abutting feature abuts against the second abutting feature to bring the cover plate to rotate with the first handle. The engaging structure is brought to engage with the locking slot structure to fix the first handle set on the mounting plate.

According to yet another embodiment of the present disclosure, a method for dismounting a lock from a door is disclosed. The lock includes a mounting plate and a first handle set. The mounting plate is fixed on a side of the door and includes a locking slot structure. The first handle set includes a cover plate. The cover plate includes an engaging structure and an indentation. The engaging structure is engaged with the locking slot structure to fix the first handle set on the mounting plate. The indentation is disposed at a periphery of the cover plate and exposed to an outside. The method includes steps as follows. A tool is used to drive the cover plate to rotate relative to the mounting plate via the indentation such that the engaging structure is disengaged from the locking slot structure. The first handle set is moved away from the door such that the first handle set is dismounted from the door.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
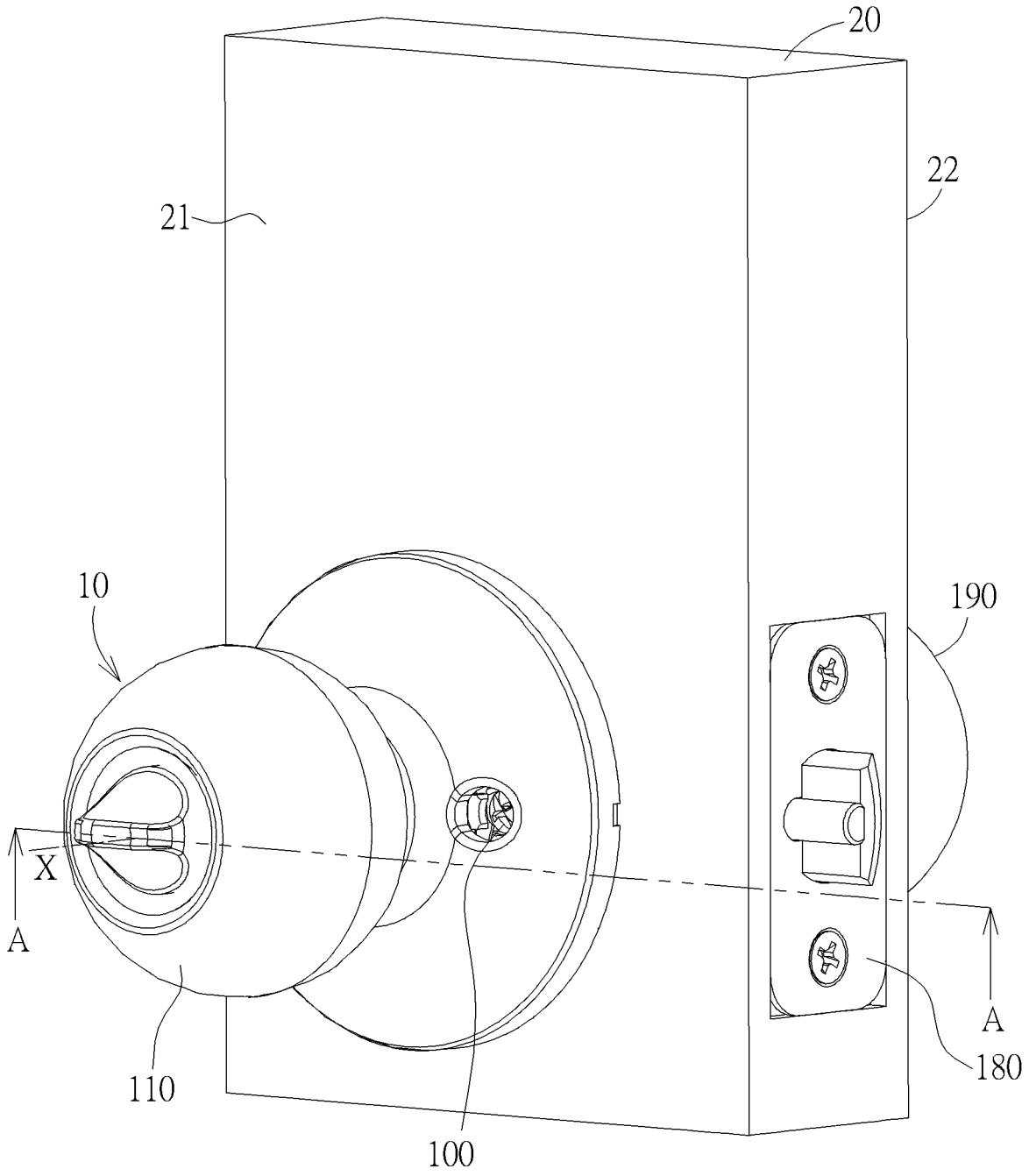
FIG. 1 is a three-dimensional diagram showing a lock mounted on a door according to one embodiment of the present disclosure.
Figure 2:
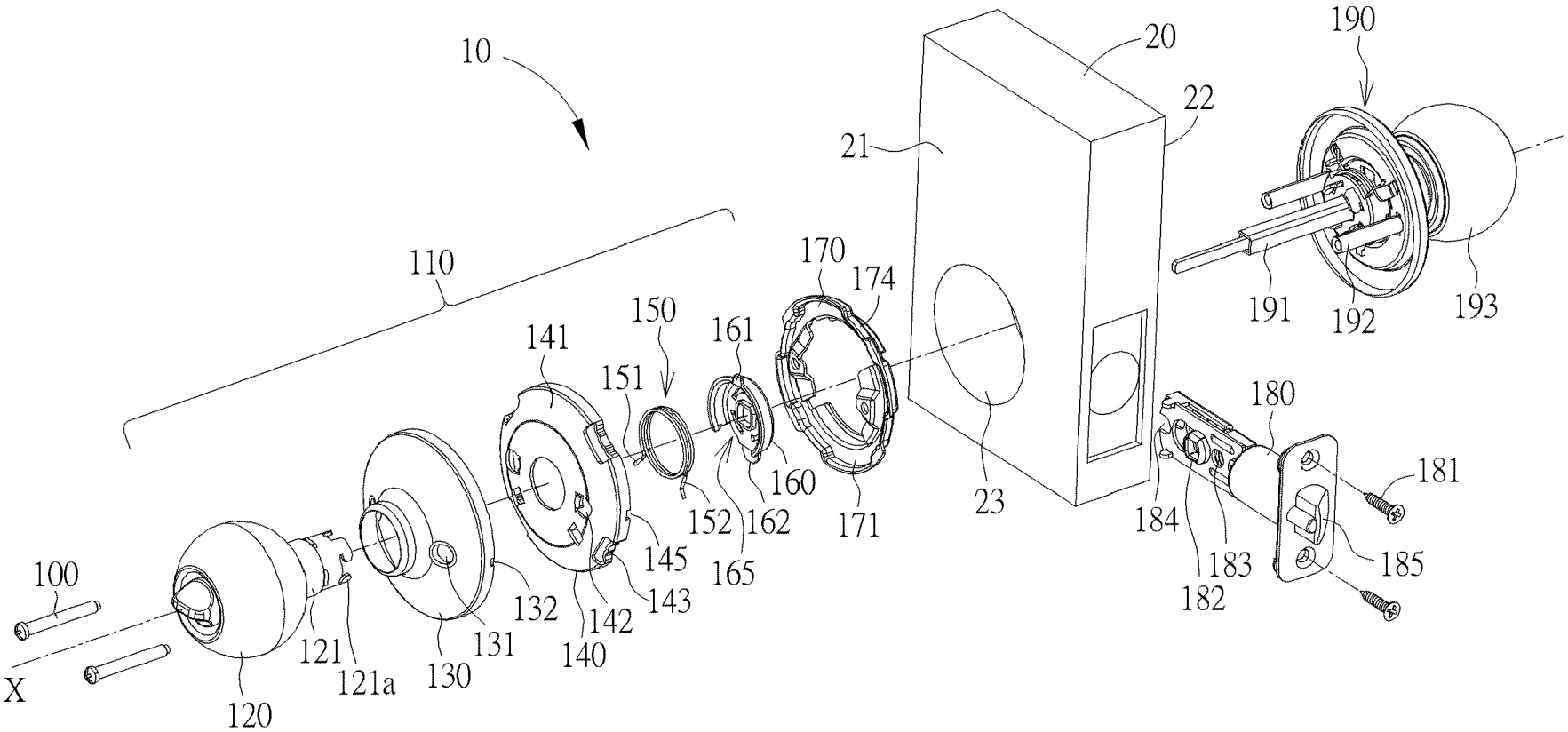
FIG. 2 is an exploded diagram showing the lock mounted on the door of FIG. 1.
Figure 3:
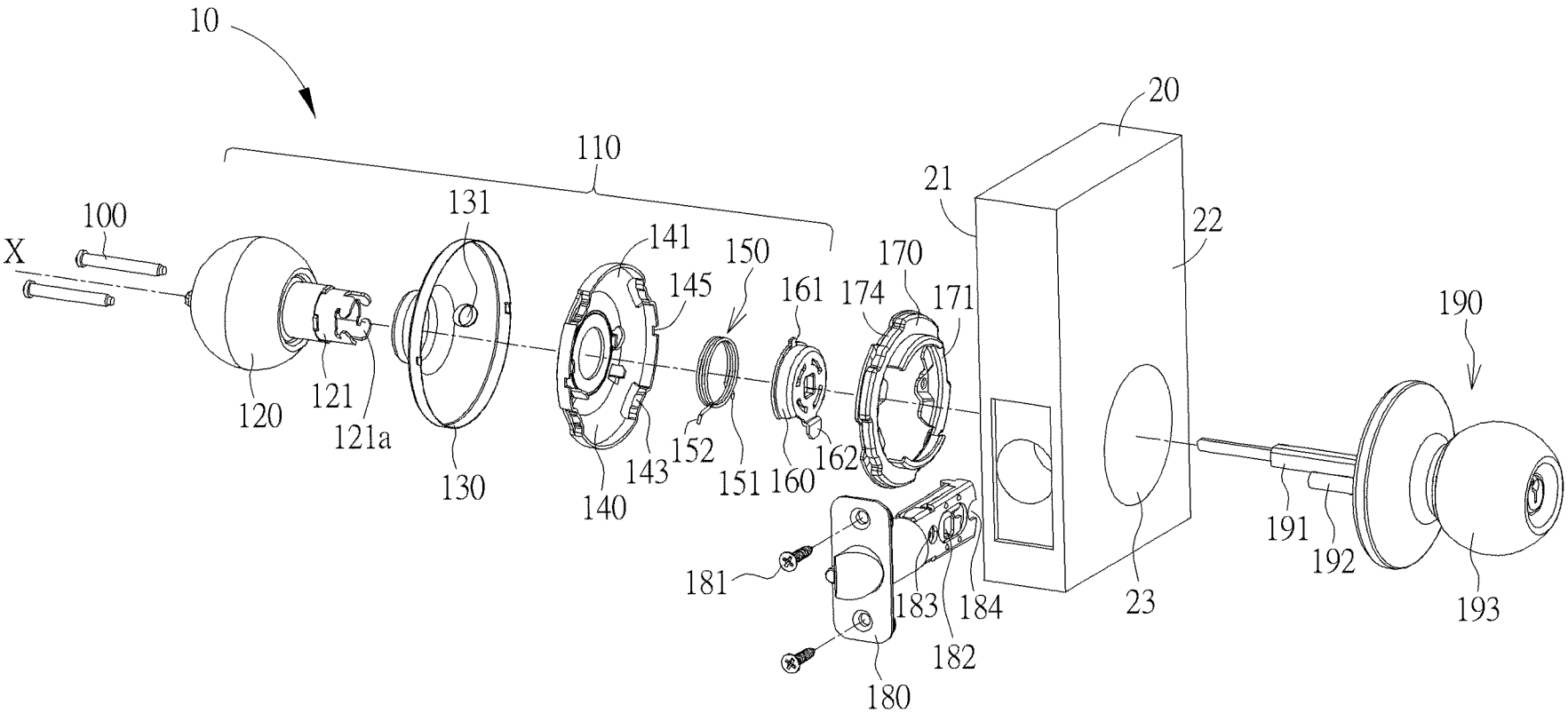
FIG. 3 is another exploded diagram showing the lock mounted on the door of FIG. 1.
Figure 4:
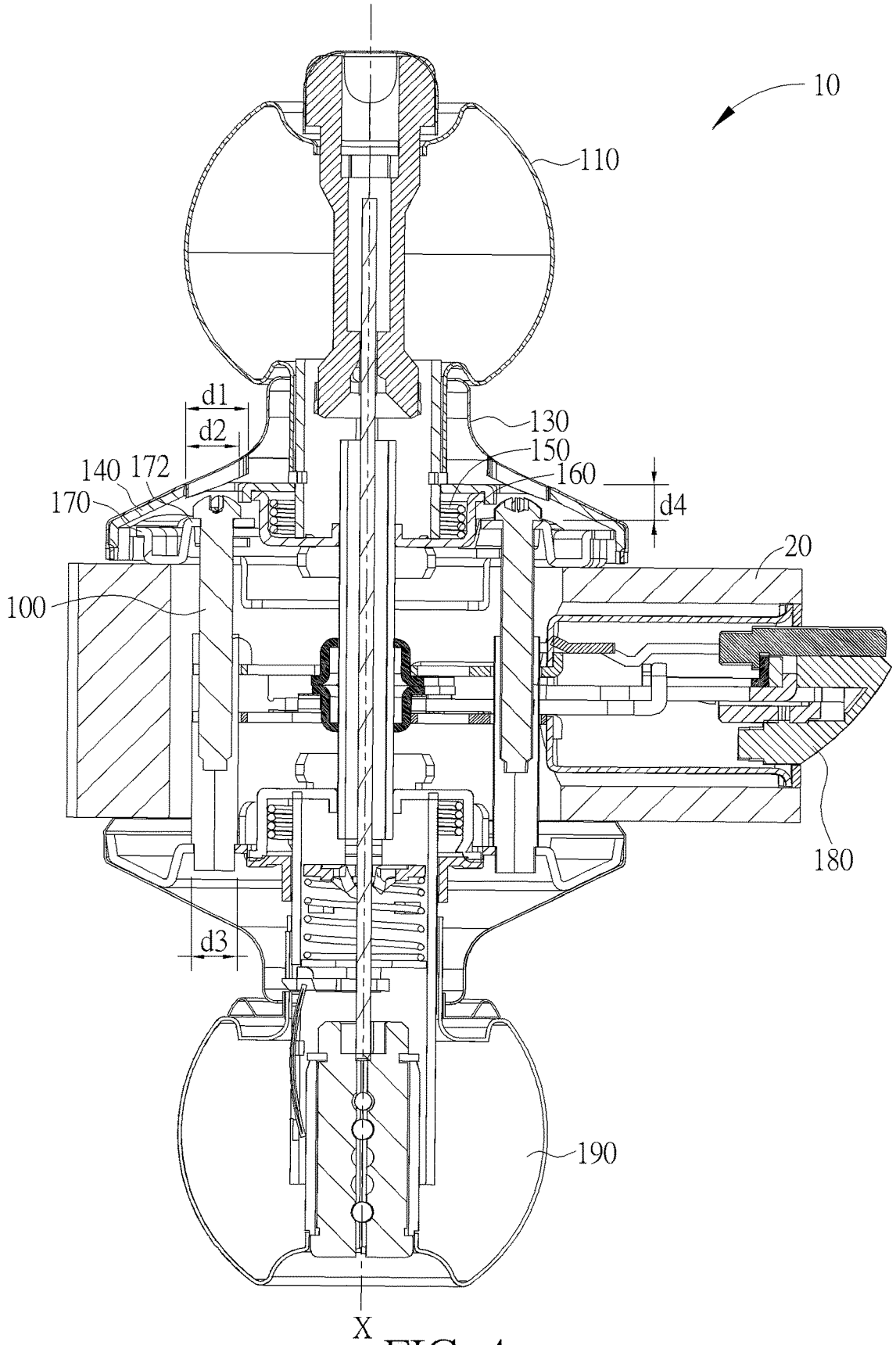
FIG. 4 is a sectional view showing the lock mounted on the door of FIG. 1.

Please refer to FIG. 1 to FIG. 4. FIG. 1 is a three-dimensional diagram showing a lock 10 mounted on a door 20 according to one embodiment of the present disclosure. FIG. 2 is an exploded diagram showing the lock 10 mounted on the door 20 of FIG. 1. FIG. 3 is another exploded diagram showing the lock 10 mounted on the door 20 of FIG. 1. FIG. 4 is a sectional view showing the lock 10 mounted on the door 20 of FIG. 1. In FIG. 1 to FIG. 4, the lock 10 defines a rotating axis X (shown in chain line) and is mounted on a mounting hole 23 of the door 20. The lock 10 includes two fastening members 100, a first handle set 110, a mounting plate 170, a latch mechanism 180 and a second handle set 190. The first handle set 110 and the mounting plate 170 are disposed on a side 21 of the door 20. The second handle set 190 is disposed on another side 22 of the door 20. The latch mechanism 180 is inserted into the mounting hole 23 and is fixed on the door 20 via two screws 181.

Figure 6:
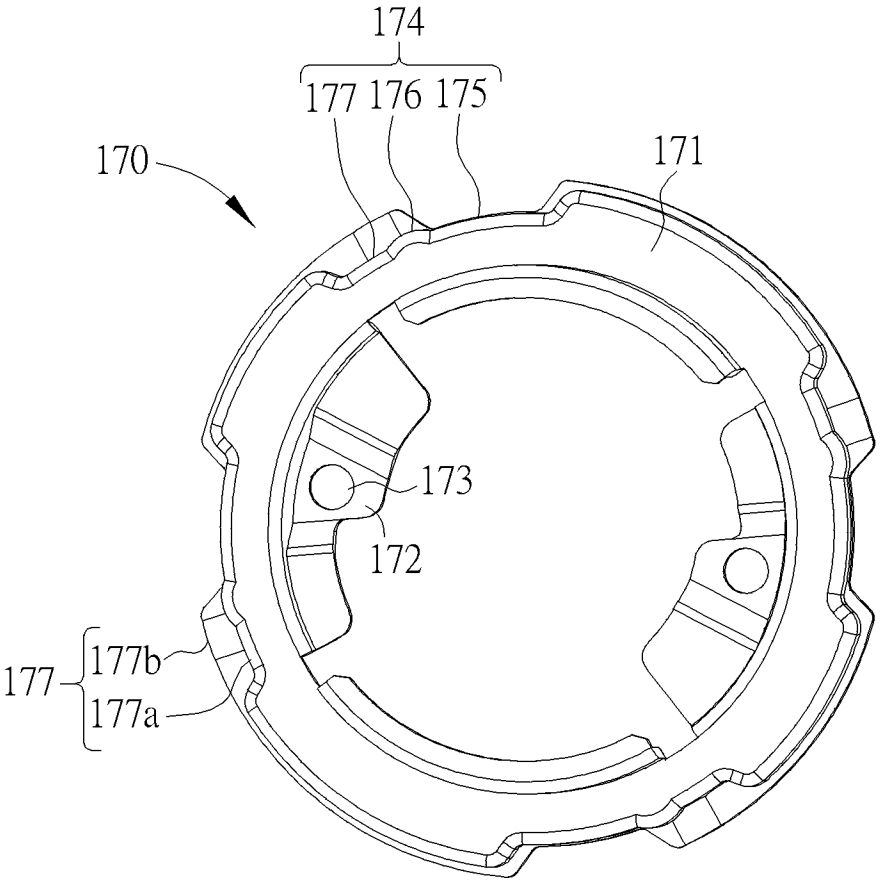
FIG. 6 is another three-dimensional diagram showing the mounting plate of FIG. 2.
Figure 5:
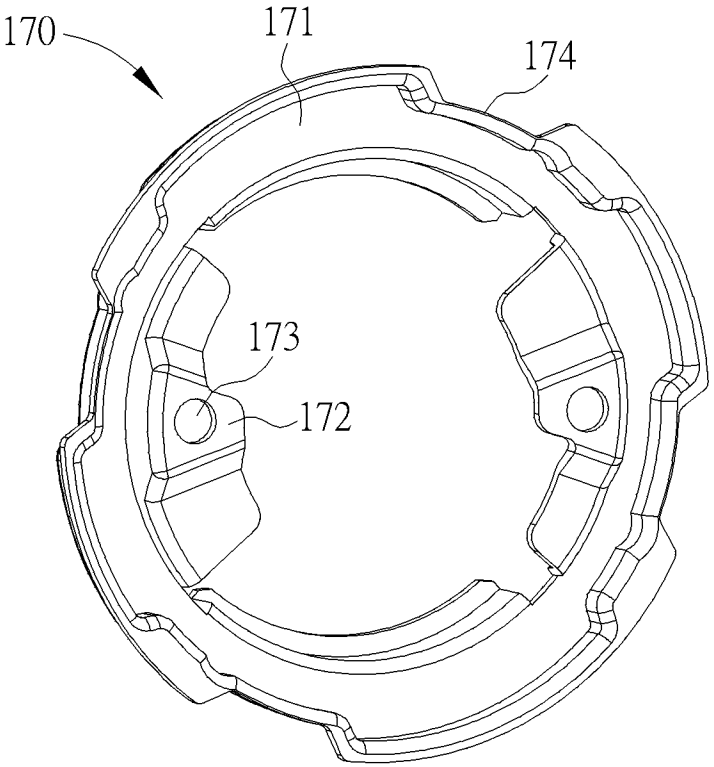
FIG. 5 is a three-dimensional diagram showing a mounting plate of FIG. 2.

Please refer to FIG. 5 and FIG. 6. FIG. 5 is a three-dimensional diagram showing the mounting plate 170 of FIG. 2. FIG. 6 is another three-dimensional diagram showing the mounting plate 170 of FIG. 2. The mounting plate 170 includes a mounting plate body 171 and two protruding lugs 172. The mounting plate body 171 includes four locking slot structures 174. The two protruding lugs 172 are connected to the mounting plate body 171 and protrude from the mounting plate body 171 toward the first handle set 110 along the rotating axis X. Each of the protruding lugs 172 includes a fastening hole 173. The fastening members 100 are inserted through the fastening holes 173 of the protruding lugs 172 to fix the mounting plate 170 on the door 20.

Please refer to FIG. 2 and FIG. 3. The first handle set 110 includes four engaging structures 143 and a decoration cover 130. The four engaging structures 143 are engaged with the four locking slot structures 174, respectively, such that the first handle set 110 is assembled and fixed on the mounting plate 170. The decoration cover 130 covers the mounting plate 170. The decoration cover 130 includes two openings 131 corresponding to the two fastening holes 173 (shown in FIG. 5). As shown in FIG. 4, a dimension d1 of the opening 131 of the decoration cover 130 is greater than a maximum radial dimension d3 of the fastening member 100. As such, a tool can be used to directly unfasten the fastening member 100 via the opening 131 of the decoration cover 130, such that the mounting plate 170 is no longer fixed to the door 20, and the mounting plate 170 and the first handle set 110 assembled on the mounting plate 170 can be dismounted from the door 20. Therefore, it is easy to dismount the lock 10 according to the present disclosure. Furthermore, as shown in FIG. 4, the two protruding lugs 172 protrude from the mounting plate body 171 toward the first handle set 110 along the rotating axis X, such that a distance d4 between the protruding lug 172 and a central point (not labeled) of the opening 131 of the decoration cover 130 can be shortened, which is favorable for directly removing the fastening member 100 via the opening 131 of the decoration cover 130.

Specifically, the first handle set 110 includes a first handle 120, an axial tube 121, the decoration cover 130, a cover plate 140, a restoring element 150 and a driving plate 160. The first handle 120 is connected with the axial tube 121, and the axial tube 121 is connected with the driving plate 160. In the embodiment, the four hooks 121*a* of the axial tube 121 are engaging into the four hook slots 164 of the driving plate 160 (shown in FIG. 9), such that the decoration cover 130, the cover plate 140 and the restoring element 150 can be fixed between the first handle 120 and the driving plate 160 to form the first handle set 110.

The decoration cover 130 further includes two side slots 132 disposed at a periphery of the decoration cover 130.

Figure 8:
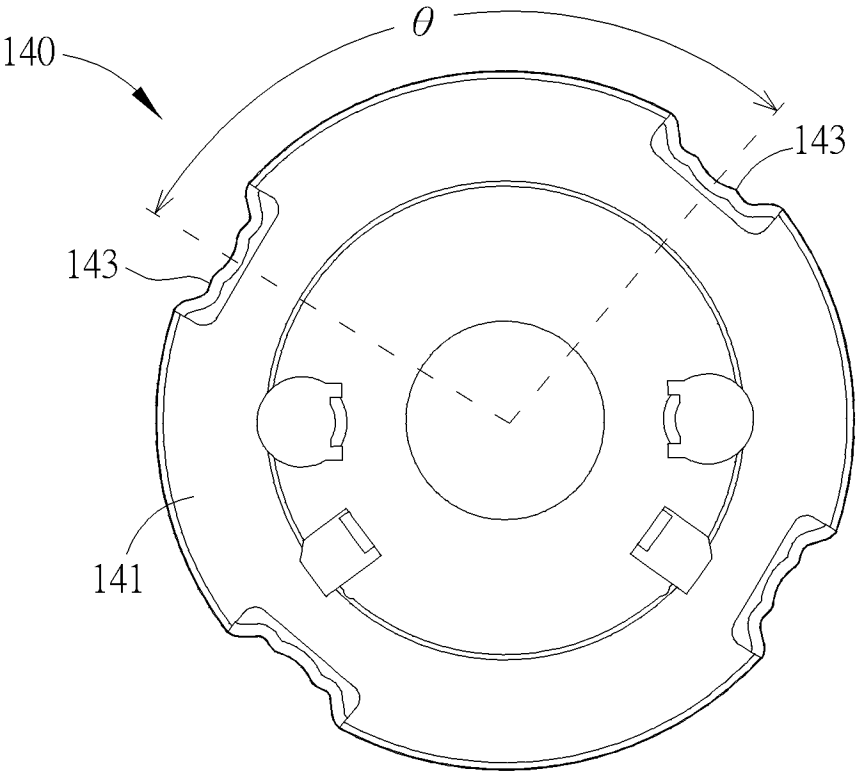
FIG. 8 is a front view showing the cover plate of FIG. 2.
Figure 7:
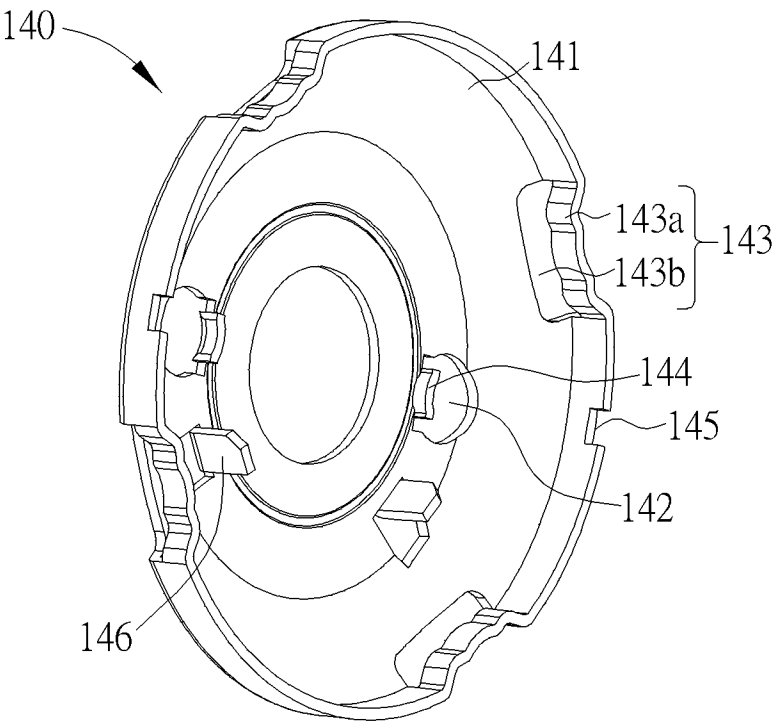
FIG. 7 is a three-dimensional diagram showing a cover plate of FIG. 2.

The cover plate 140 is disposed between the decoration cover 130 and the mounting plate 170. Please refer to FIG. 7 and FIG. 8. FIG. 7 is a three-dimensional diagram showing the cover plate 140 of FIG. 2. FIG. 8 is a front view showing the cover plate 140 of FIG. 2. The cover plate 140 includes a cover plate body 141, two second abutting features and two limiting posts 146. In the embodiment, each of the second abutting features is an obstruction post 144 protruding from the cover plate body 141. However, the present disclosure is not limited thereby. The function of the second abutting features is illustrated below. Each of the limiting posts 146 is protruding from the cover plate body 141 for limiting a position of the restoring element 150. The cover plate body 141 includes two penetrating holes 142, the four engaging structures 143 and two indentations 145. The penetrating holes 142 are corresponding to the fastening holes 173 and the openings 131. As shown in FIG. 4, a dimension d2 of the penetrating hole 142 is greater than the maximum radial dimension d3 of the fastening member 100. As such, the fastening member 100 can pass through the penetrating hole 142 and can be removed from the opening 131 of the decoration cover 130. The engaging structures 143 are corresponding to the locking slot structures 174 of the mounting plate 170. The engaging structures 143 are disposed at a periphery of the cover plate body 141, and each of the engaging structures 143 includes an elastic protruding portion 143*a* and an opening structure 143*b*. An included angle θ between two engaging structures 143 adjacent to each other can be 80 degrees to 100 degrees. Specifically, when the included angle θ between two engaging structures 143 adjacent to each other is 90 degrees, the four engaging structures 143 are disposed symmetrically, which is favorable for enhancing the engaging stability. When the included angle θ between two engaging structures 143 adjacent to each other is greater than 90 degrees and is less than 100 degrees, or when the included angle θ between two engaging structures 143 adjacent to each other is greater than 80 degrees and is less than 90 degrees, it is favorable for identifying the direction of the cover plate 140 and is favorable for the fool-proof property. The indentations 145 are disposed at the periphery of the cover plate body 141 and are corresponding to the side slots 132 of the decoration cover 130, such that the indentations 145 can be exposed to an outside through the side slots 132.

Please refer to FIG. 2 and FIG. 3. The restoring element 150 is disposed between the cover plate 140 and the driving plate 160. The restoring element 150 is for providing a restoring force to the driving plate 160. Herein, the restoring element 150 is a torsion spring and includes a first leg 151 and a second leg 152. The driving plate 160 is disposed on the cover plate body 141 and rotatable relative to the rotating axis X. That is, the driver plate 160 is disposed on the cover plate body 141 in a manner that the driving plate 160 is rotatable around the rotating axis X.

Figure 10:
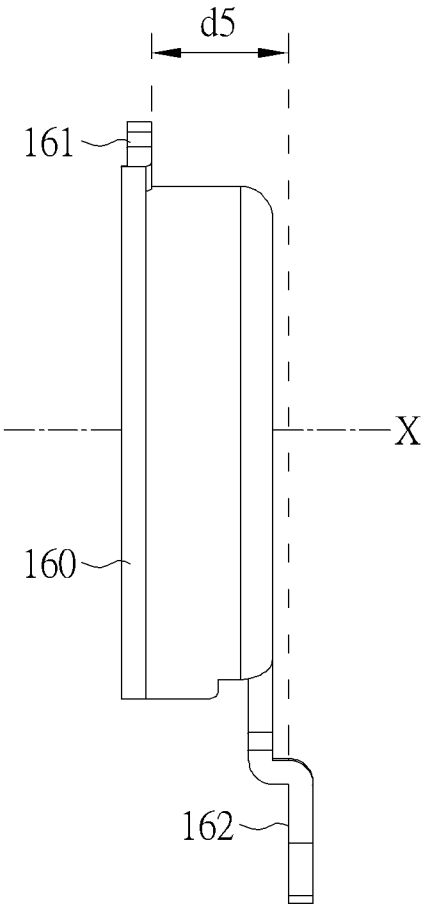
FIG. 10 is a side view showing the driving plate of FIG. 2.
Figure 9:
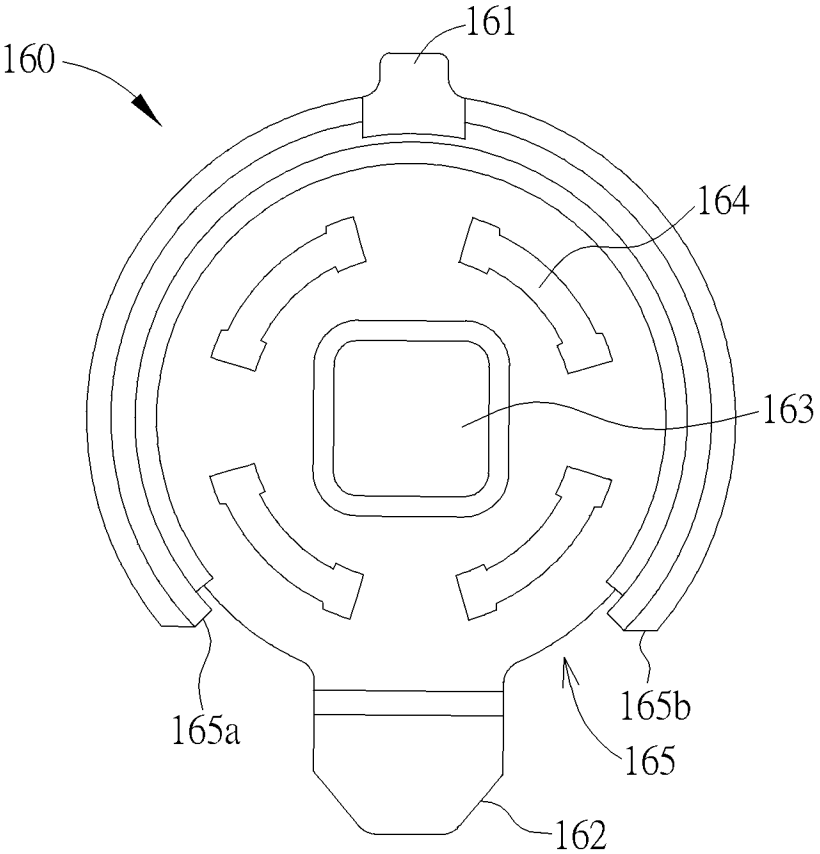
FIG. 9 is a front view showing a driving plate of FIG. 2.

Please refer to FIG. 9 and FIG. 10. FIG. 9 is a front view showing the driving plate 160 of FIG. 2. FIG. 10 is a side view showing the driving plate 160 of FIG. 2. The driving plate 160 includes a first abutting feature, a second protruding tab 162, a center hole 163, four hook slots 164 and a limiting slot 165. In the embodiment, the first abutting feature is a first protruding tab 161, the first abutting feature of the driving plate 160 is for abutting against the second abutting feature of the cover plate 140. With the first abutting feature abutting against the second abutting feature, when the driving plate 160 is operated to rotate, the cover plate 140 can be driven to rotate with the driving plate 160. In the embodiment, the first abutting feature is the first protruding tab 161 and the second abutting feature is the obstruction post 144, which are only for exemplary and the present disclosure is not limited thereto. Any structure or configuration capable of achieving the aforementioned function can be the first abutting feature and the second abutting feature of the present disclosure. The first protruding tab 161 is perpendicular to the rotating axis X and extended outwardly. The second protruding tab 162 is perpendicular to the rotating axis X and extended outwardly. As shown in FIG. 10, the second protruding tab 162 is spaced from the first protruding tab 161 by a distance d5 along the rotating axis X, such that the second protruding tab 162 is blockable by the fastening member 100 when the driving plate 160 is operated to rotate. The limiting slot 165 is provided for the first leg 151 and the second leg 152 of the restoring element 150 to move limitedly in the limiting slot 165. The limiting slot 165 includes a first limiting end 165*a* and a second limiting end 165*b*. When the restoring element 150 does not accumulate an elastic force, the first leg 151 is close to the first limiting end 165*a*, and the second leg 152 is close to the second limiting end 165*b*.

Please refer to FIG. 6, each of the locking slot structures 174 of the mounting plate 170 includes an entrance portion 175, a raised portion 176 and a holding portion 177 connected with each other. The holding portion 177 includes a notch 177*a* and a baffle 177*b*.

Please refer to FIG. 2, the latch mechanism 180 includes a transfer hole 182, a first through hole 183, a second through hole 184 and a latch tongue 185. Herein, the shapes of the first through hole 183 and the second through hole 184 are different. However, the present disclosure is not limited thereto. In other embodiment, the shapes of the first through hole 183 and the second through hole 184 can be the same. The second handle set 190 can include a transfer tube 191, two screw posts 192 and a second handle 193. The transfer tube 191 inserts through the transfer hole 182, and the two screw posts 192 insert through the first through hole 183 and the second through hole 184, respectively. The second handle 193 is connected to the transfer tube 191 in a manner that the second handle 193 and the transfer tube 191 can move synchronously. The transfer tube 191 is connected to the driving plate 160. Because the transfer tube 191 passes through the transfer hole 182 of the latch mechanism 180 and the center hole 163 of the driving plate 160, and the hooks 121*a* of the axial tube 121 are engaged with the hook slots 164 of the driving plate 160, the first handle 120, the driving plate 160 and the second handle 193 are connected in a manner that the first handle 120, the driving plate 160 and the second handle 193 can move synchronously. That is, when the first handle 120 is rotated, the driving plate 160 and the second handle 193 can rotate with the first handle 120. Similarly, when the second handle 193 is rotated, the driving plate 160 and the first handle 120 can rotate with the second handle 193. Furthermore, the latch tongue 185 of the latch mechanism 180 can be driven by rotating the first handle 120 or the second handle 193. In the embodiment, the screw posts 192 are corresponding to the fastening holes 173 of the protruding lugs 172. The fastening members 100 are inserted through the fastening holes 173 of the protruding lugs 172 and fastened into the screw posts 192, respectively, such that the mounting plate 170 and the second handle set 190 are fixed on the door 20 simultaneously. However, the present disclosure is not limited thereto. The mounting plate 170 and the second handle set 190 can align with the latch mechanism 180 respectively and then be fixed to the door 20 by other fixing means.

With the aforementioned structure, the driving plate 160 is operated to rotate such that the first protruding tab 161 abuts against the obstruction post 144 for driving the cover plate 140 to rotate with the driving plate 160, such that the engaging structure 143 is brought to engage with the locking slot structure 174, and the first handle set 110 is assembled and fixed on the mounting plate 170. FIG. 11 to FIG. 14 are provided for illustrating how to operate the driving plate 160 to bring the engaging structure 143 to engage with the locking slot structure 174. For clearly illustrating, only relevant elements are shown in FIG. 11 to FIG. 14, i.e., only the cover plate 140, the restoring element 150 (only the first leg 151 and the second leg 152 are shown), the driving plate 160 and the mounting plate 170 are shown in FIG. 11 to FIG. 14, and the elements covered by the mounting plate 170 (such as the penetrating holes 142 and the obstruction posts 144 of the cover plate 140) are depicted in dashed line.

Figure 11:
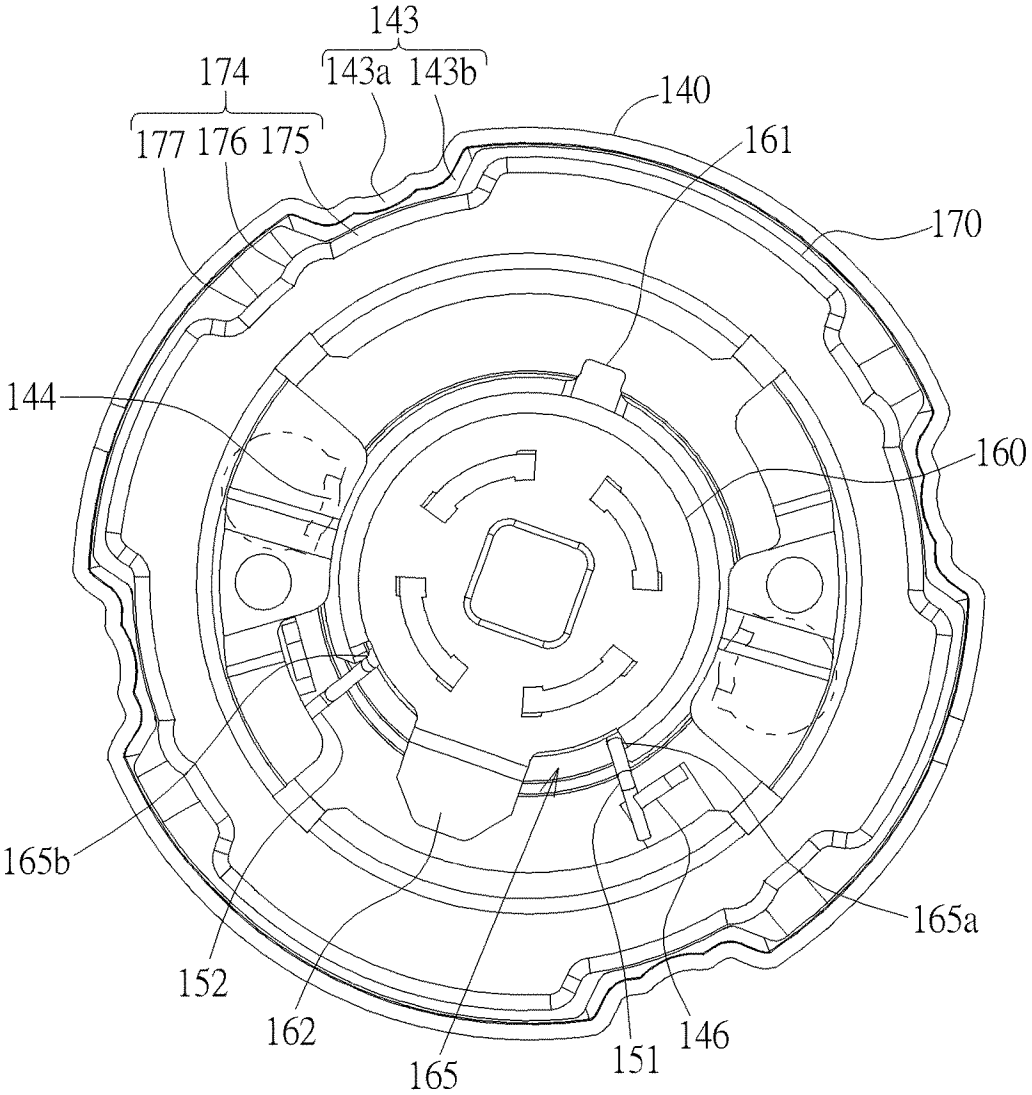
FIG. 11 is a schematic view showing a first relative position of the cover plate, a restoring element, the driving plate and the mounting plate.

First, the cover plate 140 of the first handle set 110 is rotated, such that the engaging structure 143 of the cover plate 140 is aligned with the entrance portion 175 of the locking slot structure 174 of the mounting plate 170. Specifically, the elastic protruding portion 143*a* of the engaging structure 143 is aligned with the entrance portions 175 of the locking slot structure 174, as shown in FIG. 11. Then the first handle set 110 is moved toward the door 20 along the rotating axis X, such that the elastic protruding portion 143*a* of the engaging structure 143 enters into the entrance portion 175.

Figure 12:
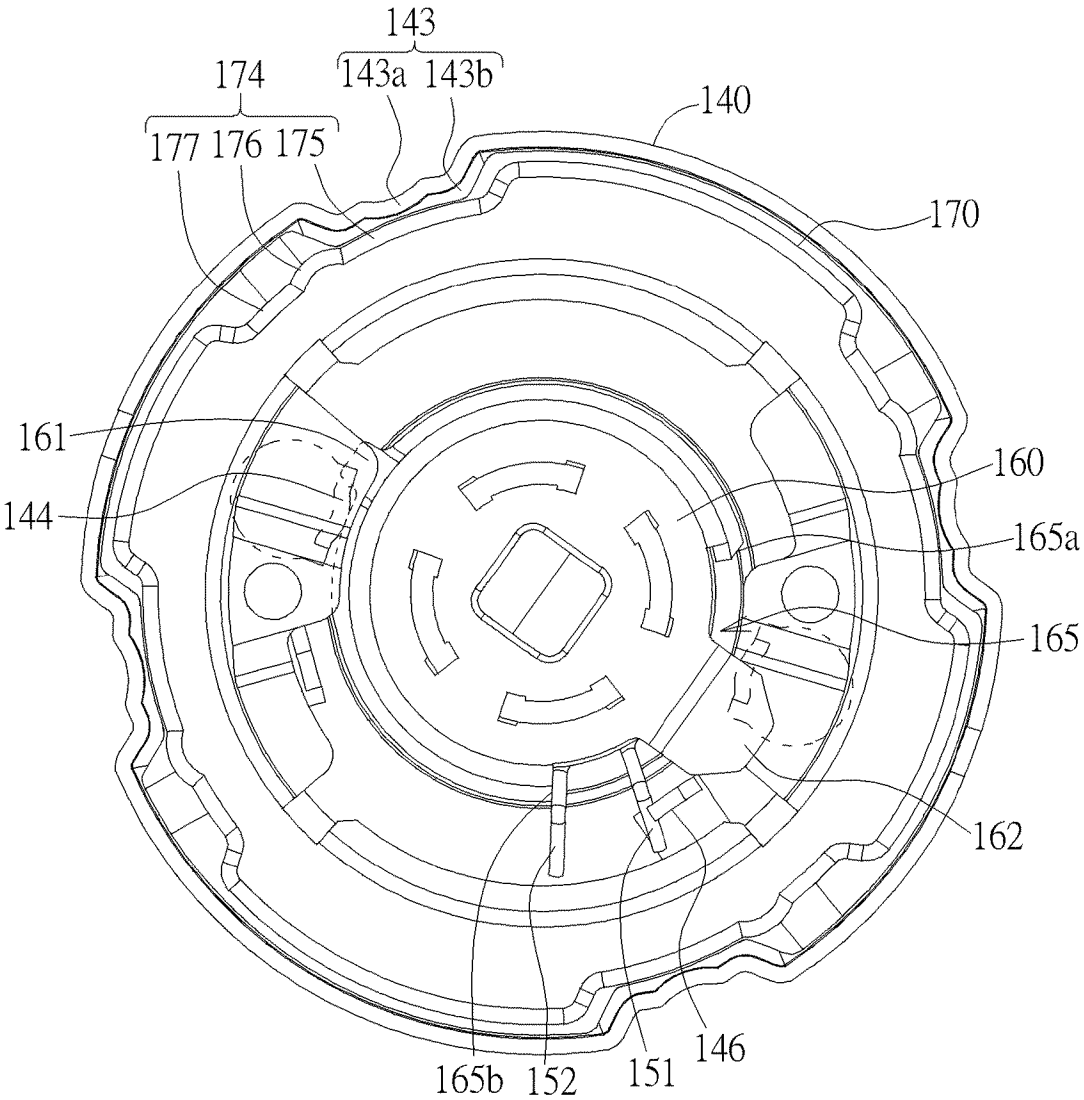
FIG. 12 is a schematic view showing a second relative position of the cover plate, the restoring element, the driving plate and the mounting plate.

Second, the first handle 120 of the first handle set 110 is rotated to bring the driving plate 160 to rotate with the first handle 120 till the first protruding tab 161 abuts against the obstruction post 144, as shown in FIG. 12. By this time, the first leg 151 of the restoring element 150 is blocked by the limiting post 146 and stays at the same position, and the second leg 152 of the restoring element 150 is brought to rotate by the second limiting end 165*b* of the driving plate 160, such that the restoring element 150 accumulates an elastic force.

Figure 13:
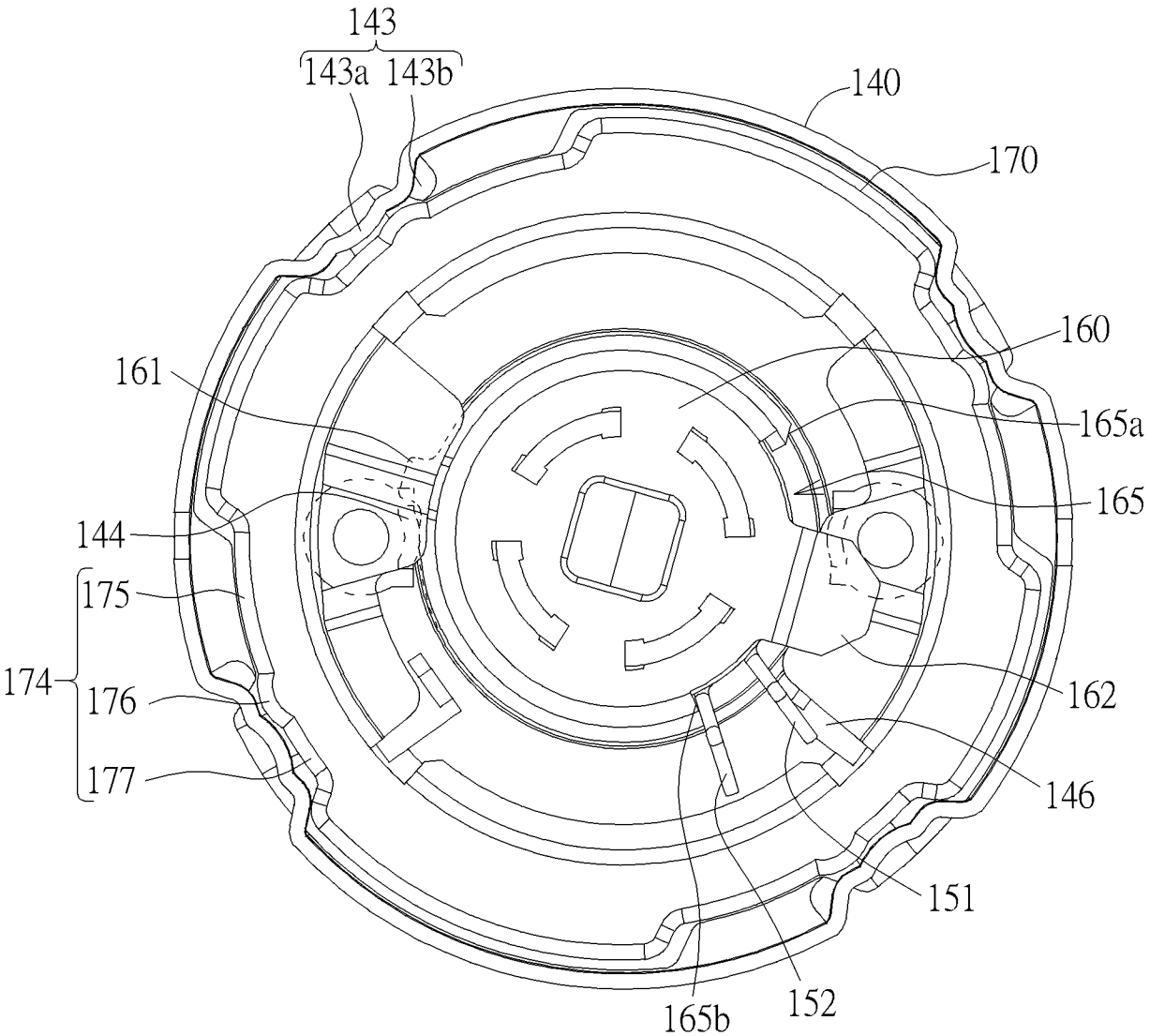
FIG. 13 is a schematic view showing a third relative position of the cover plate, the restoring element, the driving plate and the mounting plate.

Then the first handle 120 of the first handle set 110 is continuously rotated to bring the driving plate 160 to rotate with the first handle 120 continuously. Because the first protruding tab 161 abuts against the obstruction post 144, the cover plate 140 is brought to rotate with the driving plate 160. When the cover plate 140 is rotated, the elastic protruding portion 143*a* of the engaging structure 143 of the cover plate 140 is brought to enter into the holding portion 177 from the entrance portion 175 via slidably passing the raised portion 176, such that the engaging structure 143 and the locking slot structure 174 are in an engagement state, as shown in FIG. 13. Furthermore, a position of the second protruding tab 162 is corresponding to a position of the penetrating hole 142 of the cover plate 140. That is, when the elastic protruding portion 143*a* is located at the holding portion 177 and the engaging structure 143 and the locking slot structure 174 are in the engagement state, the second protruding tab 162 abuts against the fastening member 100 (which can refer to the position relationship of the fastening member 100 and the penetrating hole 142 shown in FIG. 2 and FIG. 3). Accordingly, the disengagement of the engaging structure 143 and the locking slot structure 174 caused by the elastic protruding portion 143*a* separated from the holding portion 177 due to excessive rotation of the driving plate 160 and the cover plate 140 can be prevented.

Since the engaging structure 143 and the locking slot structure 174 are in the engagement state, which refers that the first handle set 110 has been assembled on the mounting plate 170. By this time, let go the first handle 120, the restoring element 150 releases the elastic force such that the second leg 152 of the restoring element 150 rotate reversely. With the second leg 152 abutting against the second limiting end 165*b* of the driving plate 160, the driving plate 160 is brought back to an initial position, as shown in FIG. 14.

Figure 14:
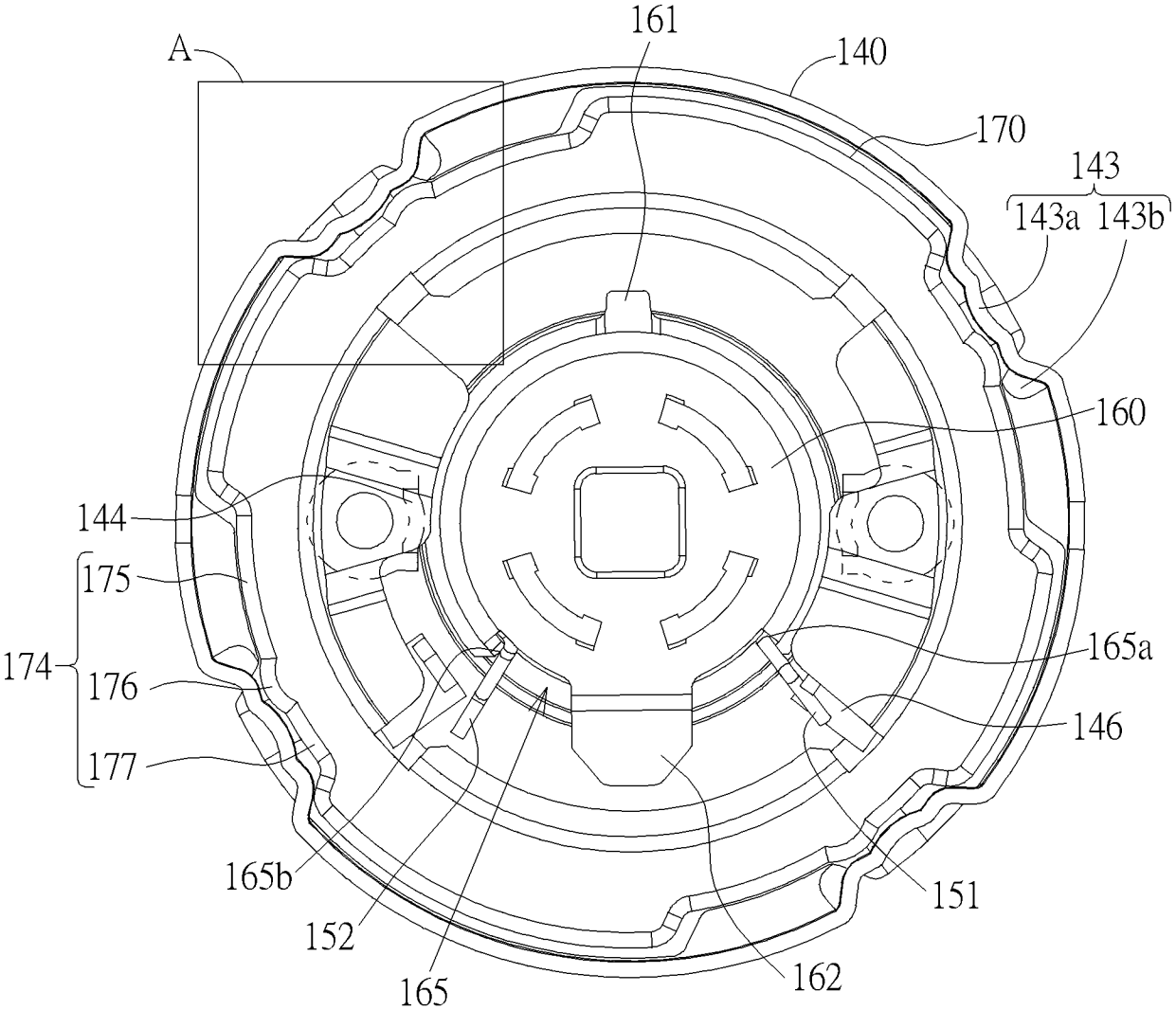
FIG. 14 is a schematic view showing a fourth relative position of the cover plate, the restoring element, the driving plate and the mounting plate.
Figure 15:
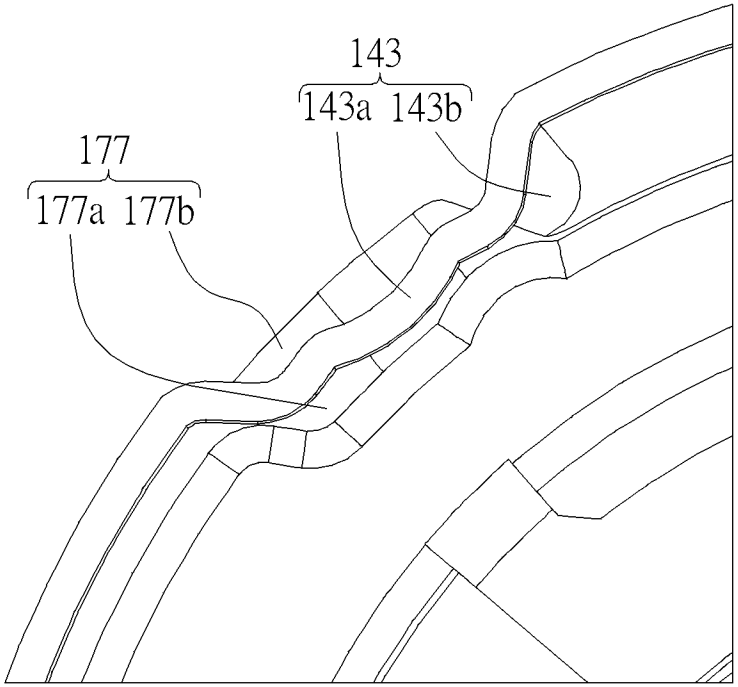
FIG. 15 is an enlarged view of a portion A of FIG. 14.

FIG. 15 is an enlarged view of a portion A of FIG. 14. As shown in FIG. 15, when the engaging structure 143 is engaged with the locking slot structure 174, the elastic protruding portion 143*a* is engaged with the notch 177*a*, and the baffle 177*b* is inserted between the elastic protruding portion 143*a* and the cover plate body 141. More specifically, the baffle 177*b* is inserted into the opening structure 143*b* between the elastic protruding portion 143*a* and the cover plate body 141. As such, the engaging stability between the engaging structure 143 and the locking slot structure 174 can be enhanced.

According to the above embodiment, the restoring element 150 is for providing the restoring force to the driving plate 160. Therefore, the restoring element 150 is selective. In other embodiment, the restoring element 150 can be omitted according to practical demands, such as for reducing weight or cost. When the restoring element 150 is omitted, and the engaging structure 143 and the locking slot structure 174 are in the engagement state, the driving plate 160 can be brought back to the initial position by rotating the first handle 120 directly.

Figure 16:
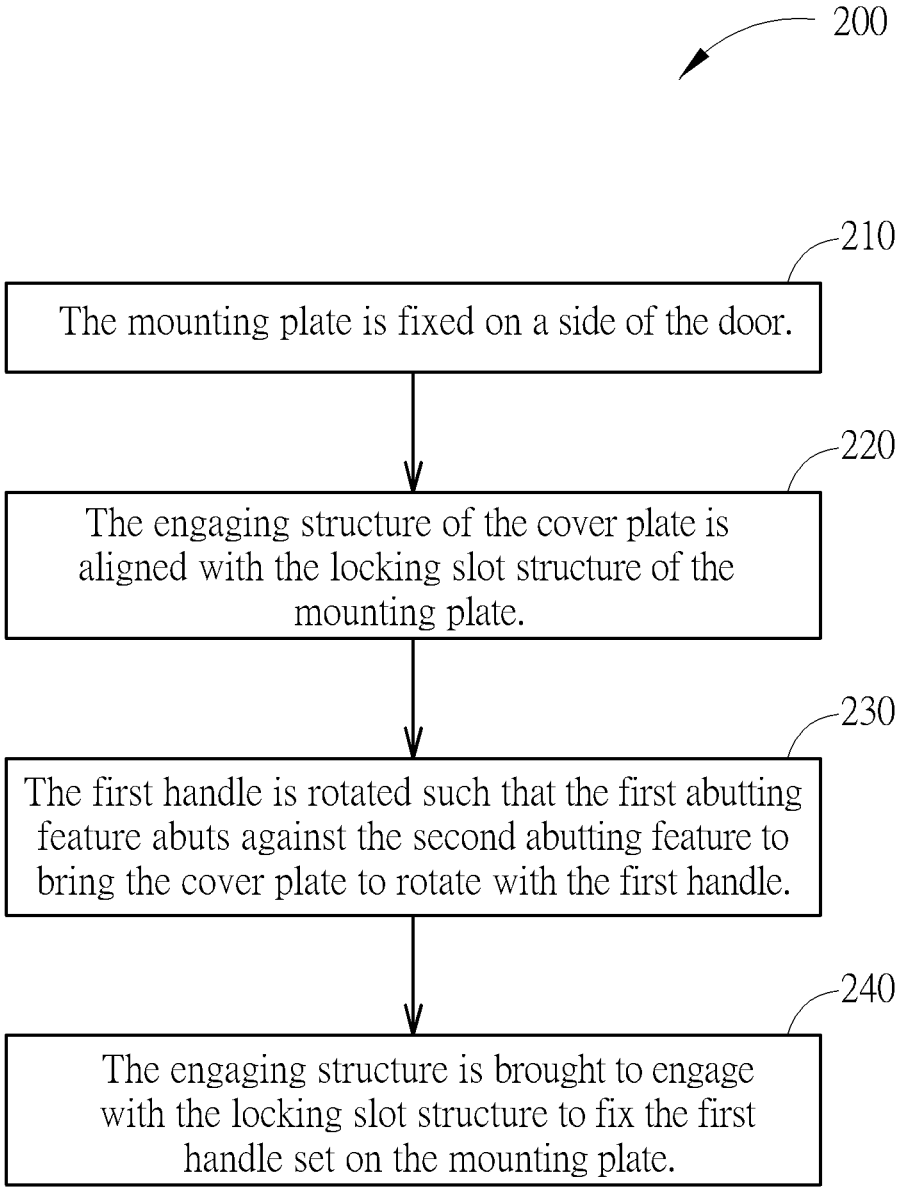
FIG. 16 is a flow chart of a method for mounting a lock on a door according to another embodiment of the present disclosure.

FIG. 16 is a flow chart of a method 200 for mounting a lock on a door according to another embodiment of the present disclosure. The method 200 includes Step 210, Step 220, Step 230 and Step 240. Please also refer to FIG. 17 to FIG. 20, FIG. 17 to FIG. 20 are schematic views illustrating Step 210 to Step 240. The lock adaptable for the method 200 includes a mounting plate and a first handle set. The mounting plate includes a locking slot structure. The first handle set includes a cover plate, a first handle and a first abutting feature. The cover plate includes an engaging structure and a second abutting structure. The first handle is rotatably connected to the cover plate. The first abutting feature is connected to the first handle in a manner that the first abutting feature is moved synchronously with the first handle. For details of the elements of the lock adaptable for the method 200, reference can be made to the elements having the same name in the lock 10. The method 200 can be used to mount the lock 10 on the door 20 of FIG. 1 to FIG. 15. For specific explanation, herein the lock 10 and the door 20 in FIG. 1 to FIG. 15 are used as the example. However, the lock adaptable for the method 200 is not limited thereto. Furthermore, the decoration cover 130 is omitted for illustrating clearly.

Figure 17:
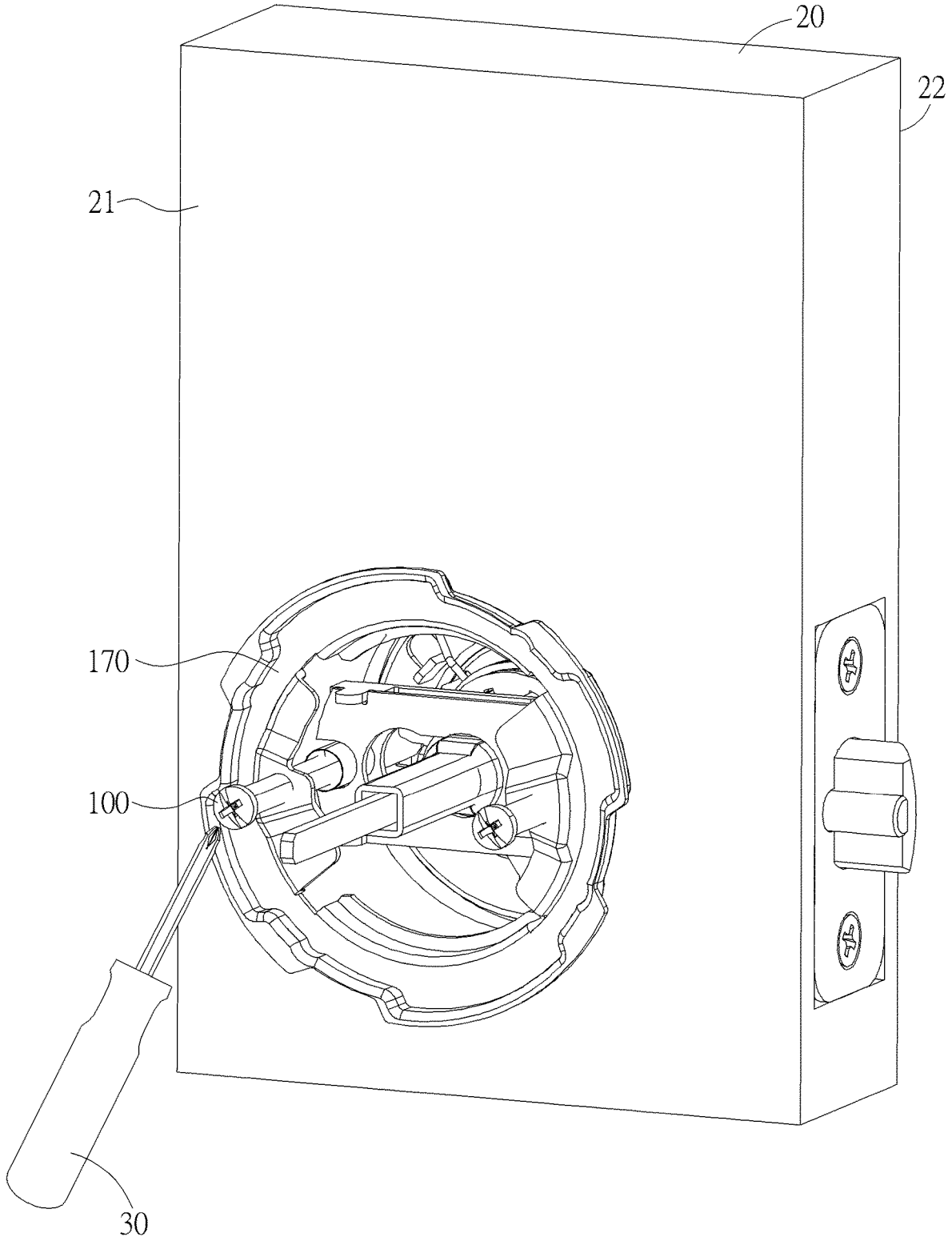
FIG. 17 is a schematic view illustrating Step 210.

In Step 210, the mounting plate 170 is fixed on the side 21 of the door 20. As shown in FIG. 17, FIG. 2 and FIG. 5, the fastening member 100 can be inserted through the fastening hole 173 of the protruding lug 172 to fix the mounting plate 170 on the door 20 by using a tool 30, such as a Phillips screwdriver. Specifically, the latch mechanism 180 can be inserted into the mounting hole 23 and fixed to the door 20 through the screws 181. Then the second handle set 190 is aligned with the latch mechanism 180, such that the transfer tube 191 is inserted into the transfer hole 182 and the two screw posts 192 are inserted into the first through hole 183 and the second through hole 184, respectively. Afterward, the fastening member 100 is inserted through the fastening hole 173 of the protruding lug 172 and is fastened into the screw post 192. As such, the mounting plate 170 and the second handle set 190 can be fixed on the two sides 20, 21 of the door 20, respectively.

Figure 18:
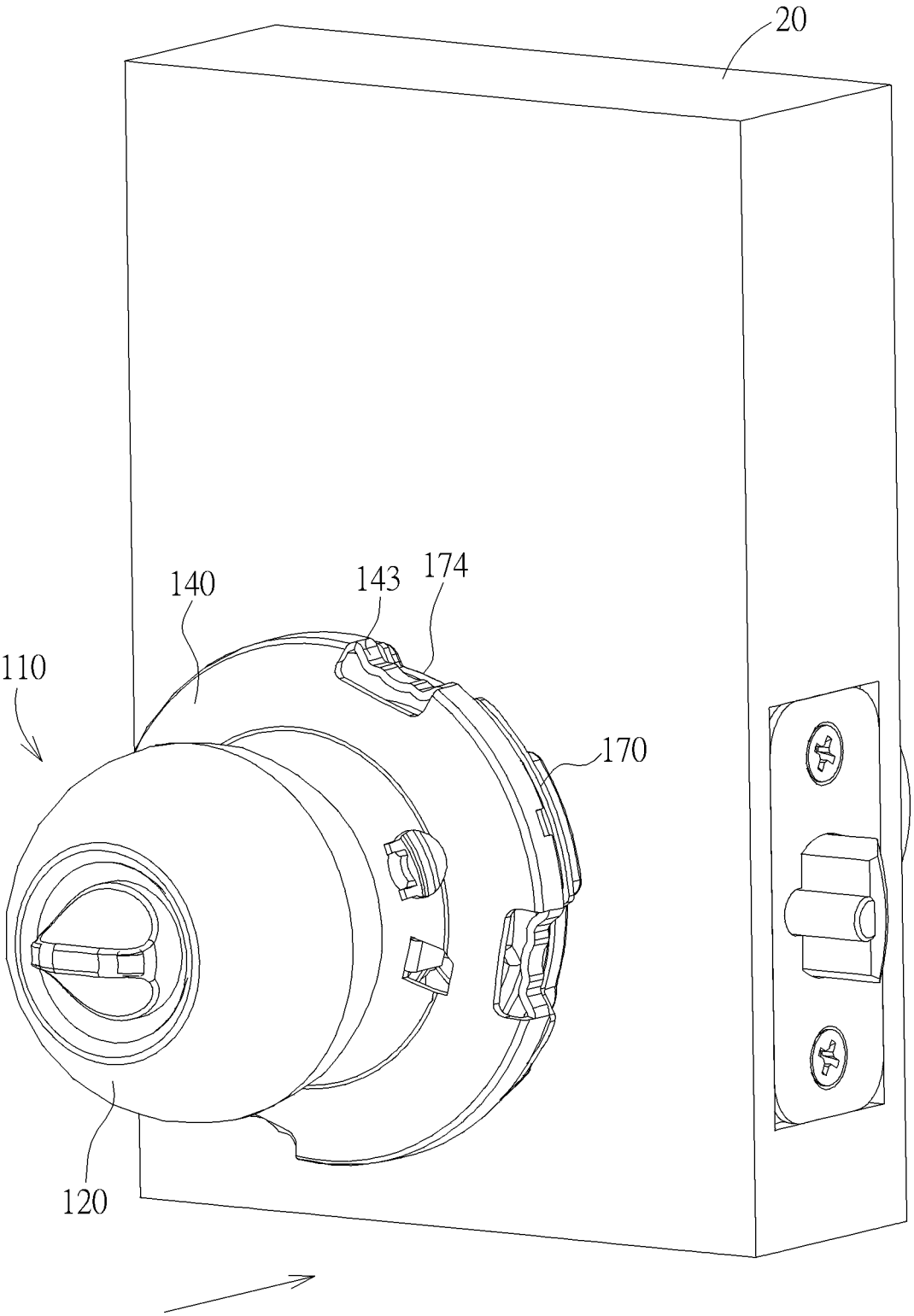
FIG. 18 is a schematic view illustrating Step 220.

In Step 220, the engaging structure 143 of the cover plate 140 is aligned with the locking slot structure 174 of the mounting plate 170. As shown in FIG. 18 and FIG. 11, in this step, the cover plate 140 of the first handle set 110 is rotated to align the elastic protruding portion 143*a* of the engaging structure 143 with the entrance portion 175 of the mounting plate 170 (the position relationship of the engaging structure 143 and the locking slot structure 174 are shown in FIG. 11). Then the cover plate 140 of the first handle set 110 is moved toward the door 20 along the direction of the arrow shown in FIG. 18. As such, the elastic protruding portion 143*a* of the engaging structure 143 enters into the entrance portion 175 of the locking slot structure 174.

Figure 19:
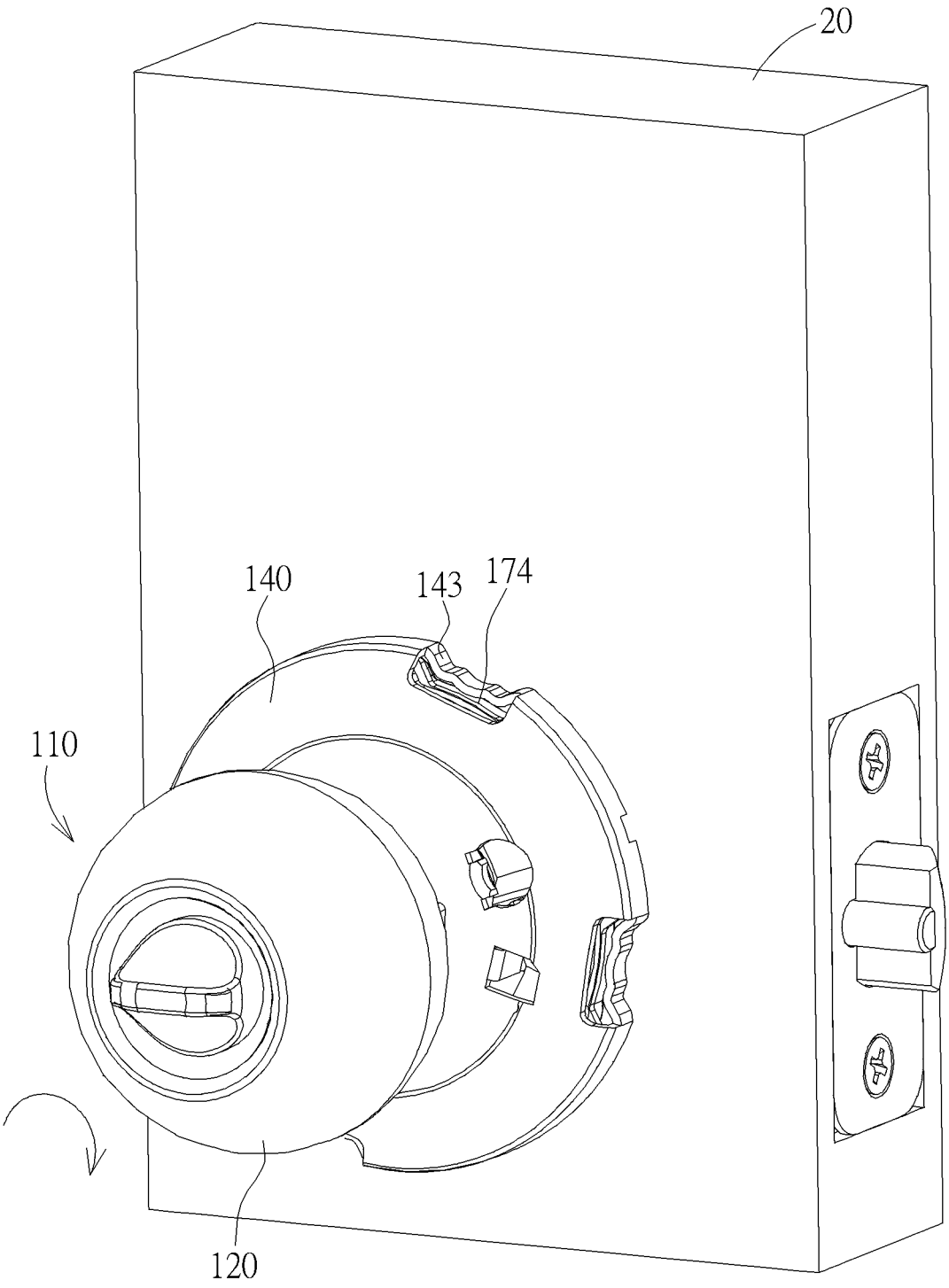
FIG. 19 is a schematic view illustrating Step 230.

In Step 230, the first handle 120 is rotated such that the first abutting feature abuts against the second abutting feature to bring the cover plate 140 to rotate with the first handle 120. As shown in FIG. 19 and FIG. 12, in this step, the first handle 120 of the first handle set 110 is rotated along the direction of the curved arrow shown in FIG. 19, such that the driving plate 160 is rotated with the first handle 120 till the first protruding tab 161 (i.e., the first abutting feature) abuts against the obstruction post 144 (i.e., the second abutting feature), as shown in FIG. 12.

Figure 20:
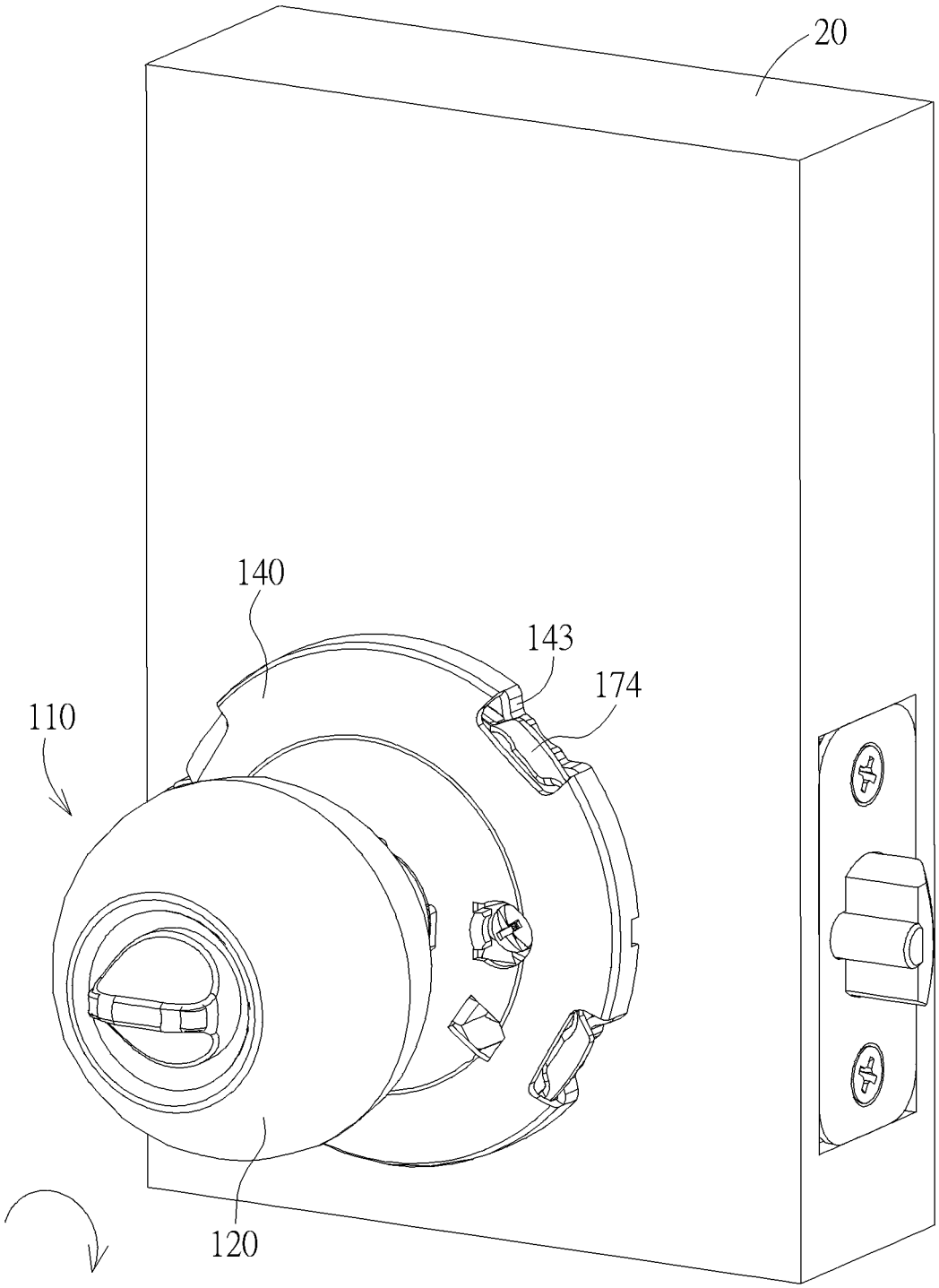
FIG. 20 is a schematic view illustrating Step 240.

In Step 240, the engaging structure 143 is brought to engage with the locking slot structure 174 to fix the first handle set 110 on the mounting plate 170. As shown in FIG. 20 and FIG. 13, the first handle 120 of the first handle set 110 is rotated continuously along the direction of the curved arrow shown in FIG. 20. As such, the driving plate 160 is rotated with the first handle 120 continuously. Because the first protruding tab 161 abuts against the obstruction post 144, the cover plate 140 is brought to rotate with the driving plate 160. When the cover plate 140 is rotated, the elastic protruding portion 143*a* of the engaging structure 143 of the cover plate 140 is brought to enter into the holding portion 177 from the entrance portion 175 via slidably passing the raised portion 176, such that the engaging structure 143 and the locking slot structure 174 are in the engagement state, as shown in FIG. 13, and the first handle set 110 is fixed on the mounting plate 170.

According to the aforementioned embodiment, the engaging structure can be engaged with the locking slot structure by rotating the first handle. As such, the first handle set and second handle set are not directly fixed and connected by screws. Accordingly, it does not need to hold the first handle set and second handle set and operate a screwdriver to screw the screws at the same time. Therefore, it is easy to mount the lock by using the method 200 of the present disclosure.

Figure 21:
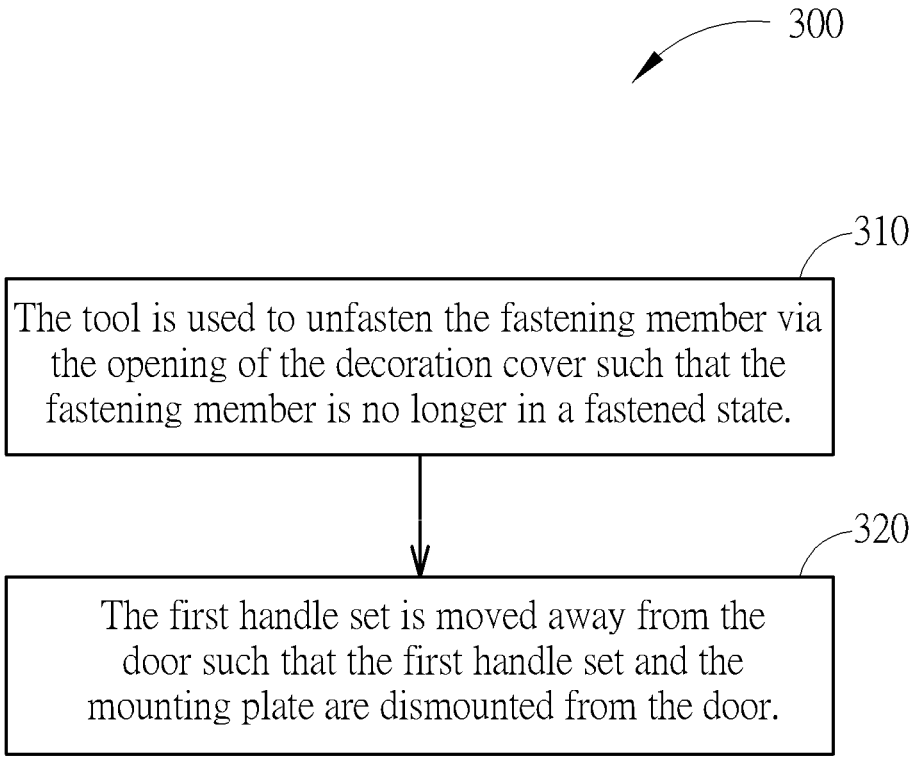
FIG. 21 is a flow chart of a method for dismounting a lock from a door according to yet another embodiment of the present disclosure.
Figure 22:
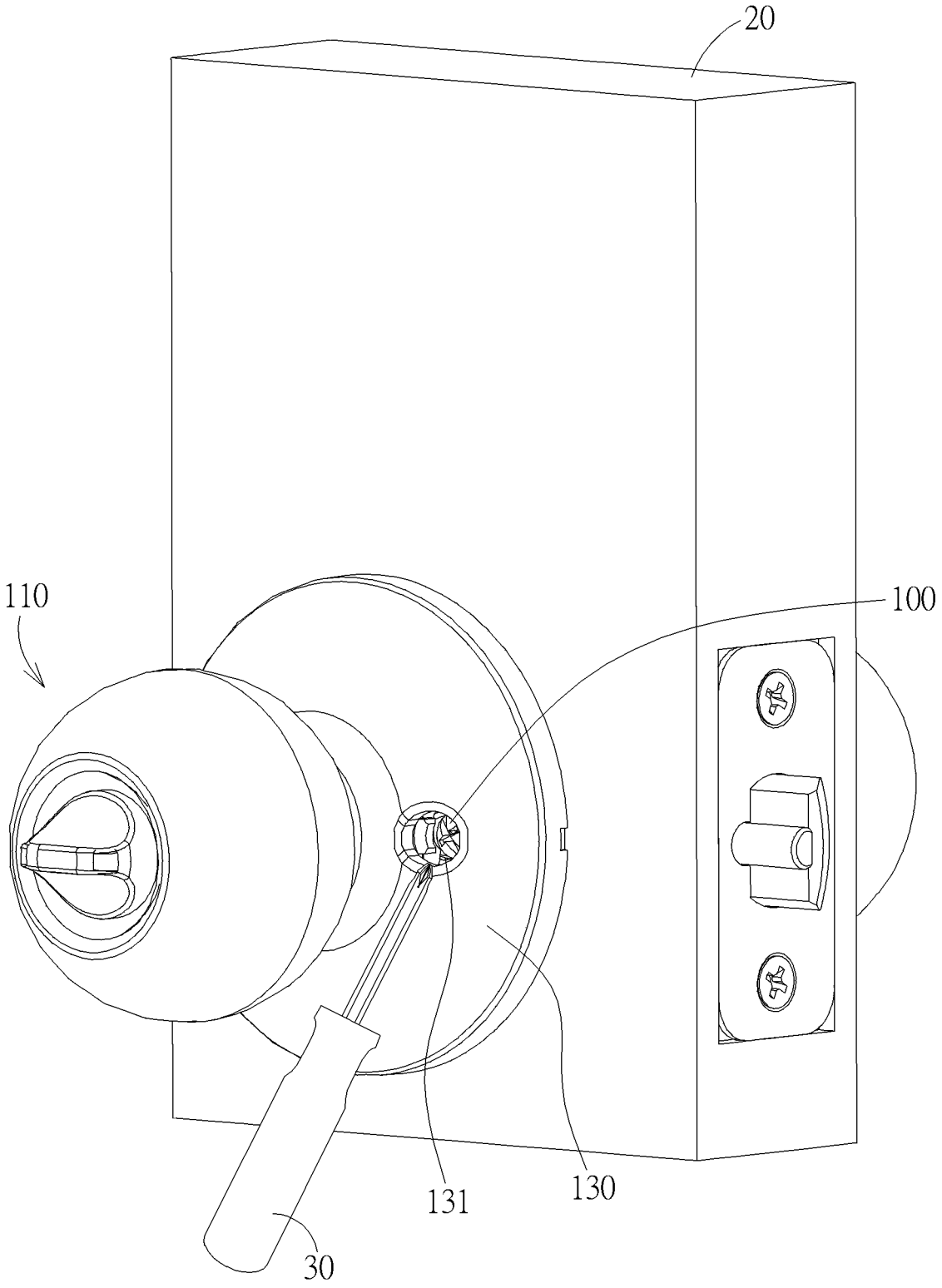
FIG. 22 is a schematic view illustrating Step 310.
Figure 23:
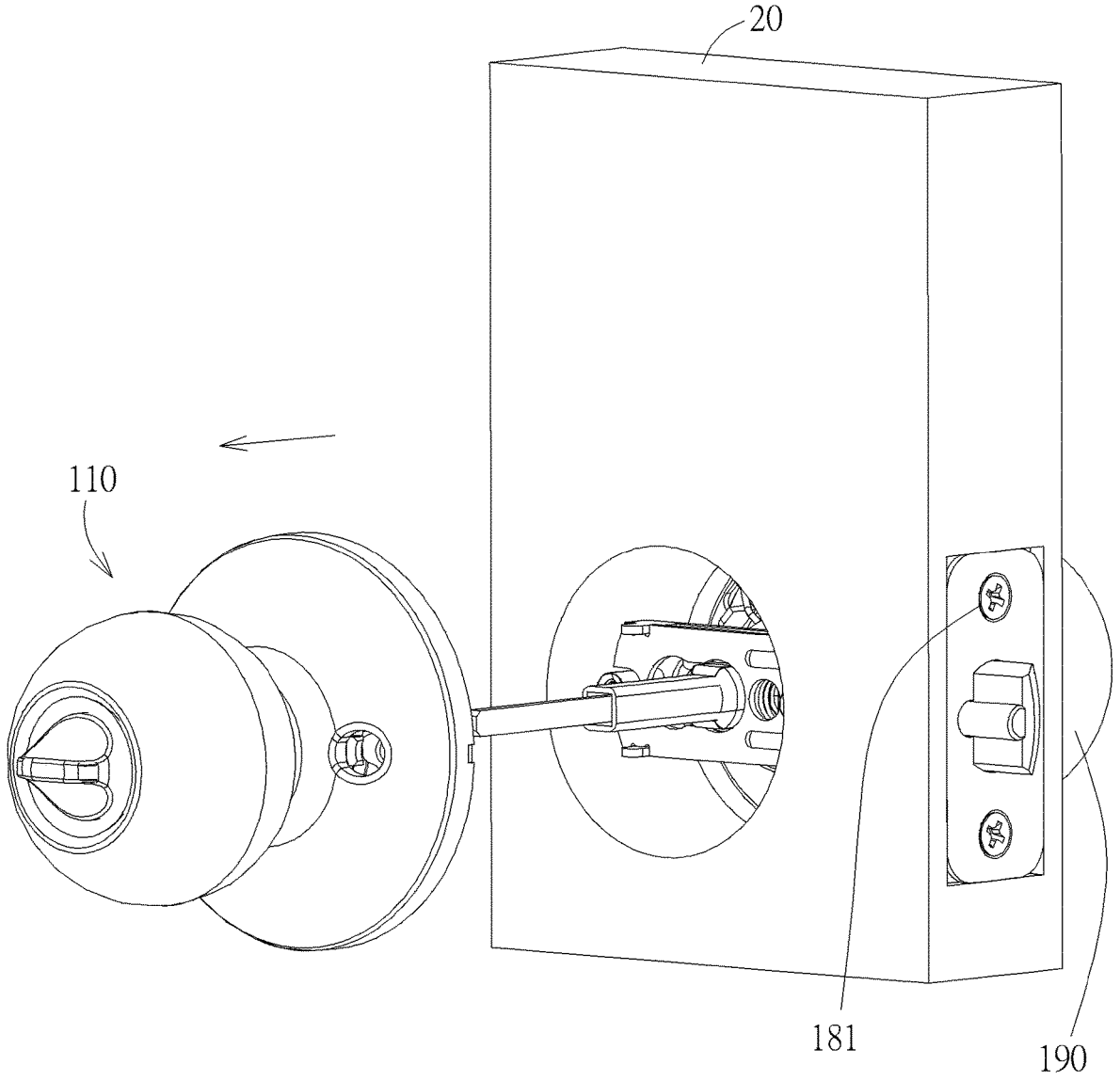
FIG. 23 is a schematic view illustrating Step 320.

FIG. 21 is a flow chart of a method 300 for dismounting a lock from a door according to yet another embodiment of the present disclosure. The method 300 includes Step 310 and Step 320. Please also refer to FIG. 22 and FIG. 23, FIG. 22 and FIG. 23 are schematic views illustrating Step 310 and Step 320. The method 300 can be used to dismount the lock 10 from the door 20 of FIG. 1 to FIG. 15. For specific explanation, herein the lock 10 and the door 20 in FIG. 1 to FIG. 15 are used as the example. However, the lock adaptable for the method 300 is not limited thereto.

In Step 310, the tool 30 is used to unfasten the fastening member 100 via the opening 131 of the decoration cover 130 such that the fastening member 100 is no longer in a fastened state. As shown in FIG. 22, the fastening member 100 can be unfastened via the opening 131 of the decoration cover 130 by using the tool 30, such as a Phillips screwdriver. As such, the fastening member 100 is no longer in a fastened state. Specifically, the fastening member 100 is unfastened from the screw post 192 (shown in FIG. 2) to be no longer in the fastened state.

In Step 320, the first handle set 110 is moved away from the door 20 such that the first handle set 110 and the mounting plate 170 are dismounted from the door 20. As shown in FIG. 23 and FIG. 2, the first handle set 110 is moved away from the door 20 along the direction of the arrow shown in FIG. 23. Because the engaging structure 143 and the locking slot structure 174 are still in the engagement state, the first handle set 110 is still fixed on the mounting plate 170. Therefore, when the first handle set 110 is moved away from the door 20, the mounting plate 170 is also moved away from the door 20 with the first handle set 110, such that the first handle set 110 and the mounting plate 170 are dismounted from the door 20.

Afterwards, the second handle set 190 can be moved away from the door 20, such that the second handle set 190 is dismounted from the door 20. Furthermore, the screws 181 can be unfastened, and the latch mechanism 180 can be removed, such that the lock 10 is completely dismounted from the door 20.

According to the aforementioned embodiment, with the dimension of the opening of the decoration cover being greater than the maximum radial dimension of the fastening member, the fastening member can be unfastened directly via the opening of the decoration cover by using a tool. As such, the first handle set and the mounting plate can be dismounted from the door and does not require removing the decoration cover before unfastening the fastening member. Therefore, it is easy to dismount the lock by using the method 300 of the present disclosure.

Figure 24:
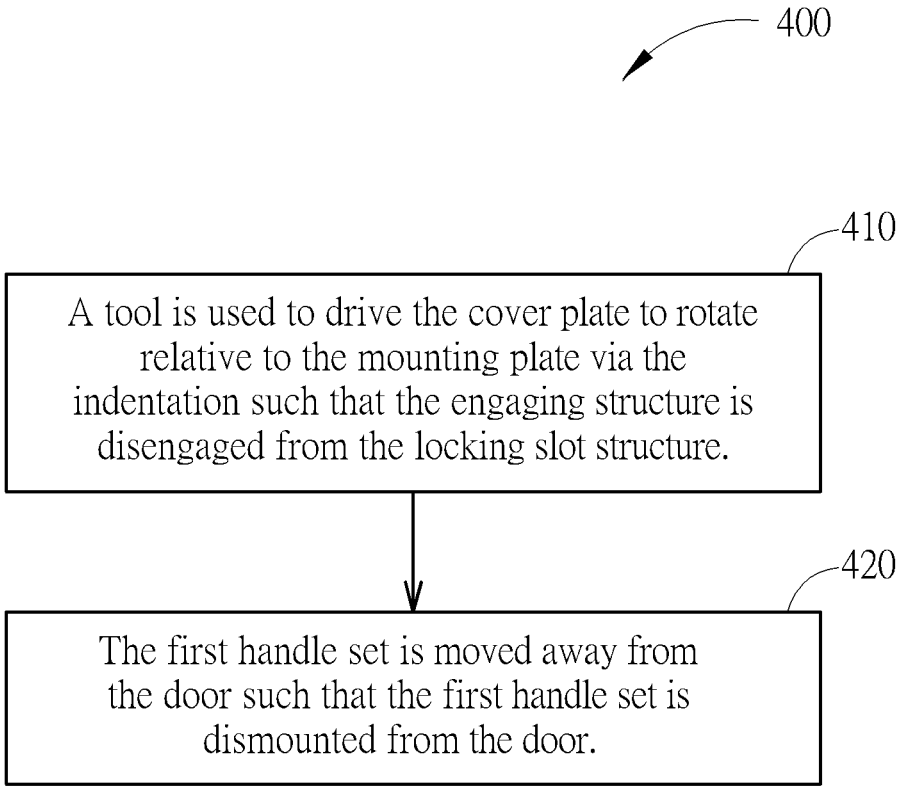
FIG. 24 is a flow chart of a method for dismounting a lock from a door according to yet another embodiment of the present disclosure.

FIG. 24 is a flow chart of a method 400 for dismounting a lock from a door according to yet another embodiment of the present disclosure. The method 400 includes Step 410 and Step 420. Please also refer to FIG. 25 and FIG. 26, which are schematic views illustrating Step 410 and Step 420. The lock adaptable for the method 400 includes a mounting plate and a first handle set. The mounting plate is fixed on a side of the door and includes a locking slot structure. The first handle set includes a cover plate. The cover plate includes an engaging structure and an indentation. The engaging structure is engaged with the locking slot structure to fix the first handle set on the mounting plate. The indentation is disposed at a periphery of the cover plate and exposed to an outside. For details of the elements of the lock adaptable for the method 400, reference may be made to the elements having the same name in the lock 10. The method 400 can be used to dismount the lock 10 from the door 20 of FIG. 1 to FIG. 15. For specific explanation, herein the lock 10 and the door 20 in FIG. 1 to FIG. 15 are used as the example. However, the lock adaptable for the method 400 is not limited thereto.

Figure 25:
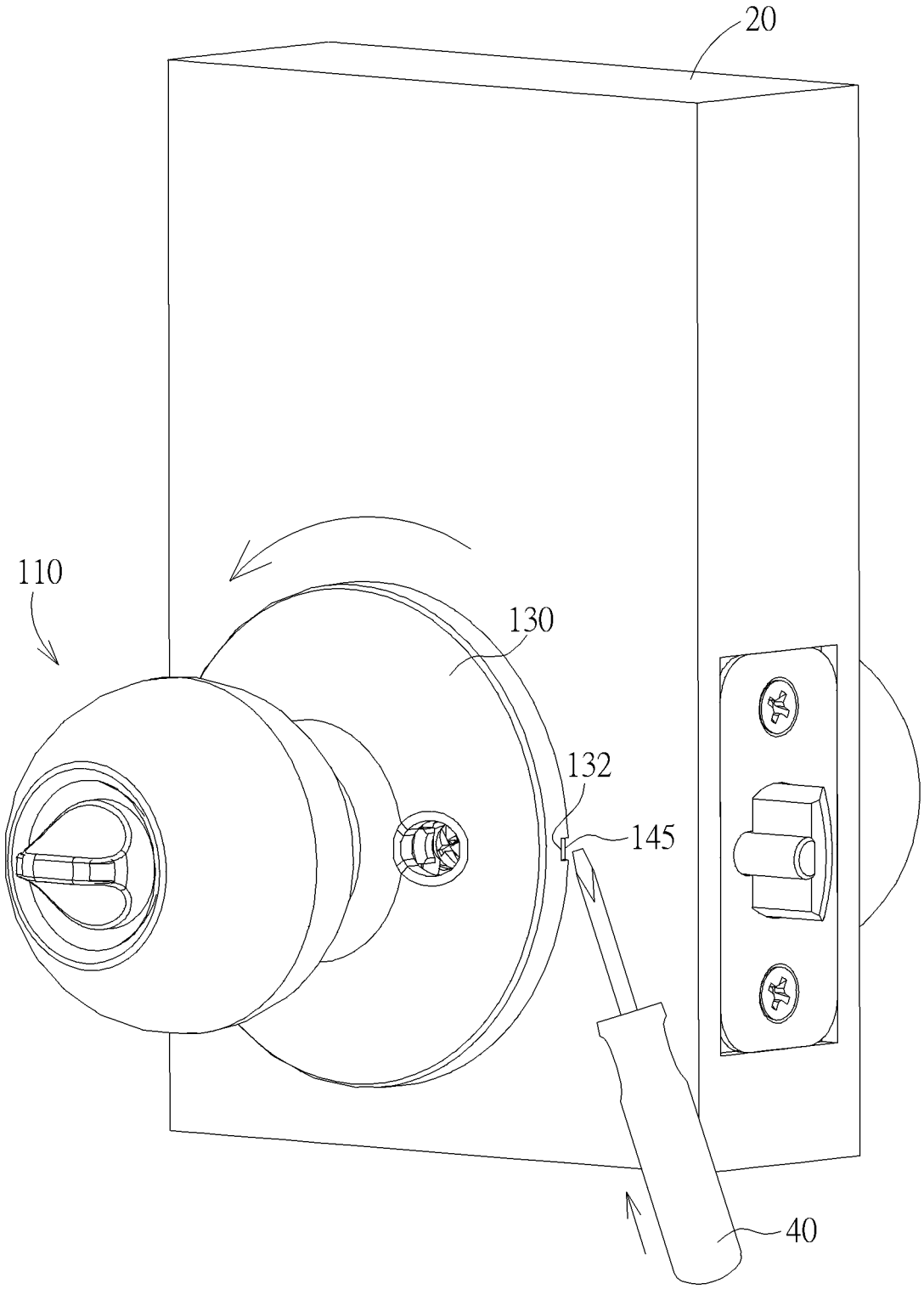
FIG. 25 is a schematic view illustrating Step 410.

In Step 410, a tool 40 is used to drive the cover plate 140 to rotate relative to the mounting plate 170 via the indentation 145 such that the engaging structure 143 is disengaged from the locking slot structure 174. As shown in FIG. 25 and FIG. 2, a tool 40, such as a flathead screwdriver, can be used to pass the side slot 132 of the decoration cover 130 to act on the indentation 145, such that the cover plate 140 is driven to rotate relative to the mounting plate 170 along the direction of the curved arrow shown in FIG. 25, and the engaging structure 143 is disengaged from the locking slot structure 174. Specifically, the state of the engaging structure 143 and the locking slot structure 174 is changed from FIG. 13 to FIG. 11 via Step 410. That is, the elastic protruding portion 143*a* is brought to the entrance portion 175 from the holding portion 177 via slidably passing the raised portion 176.

Figure 26:
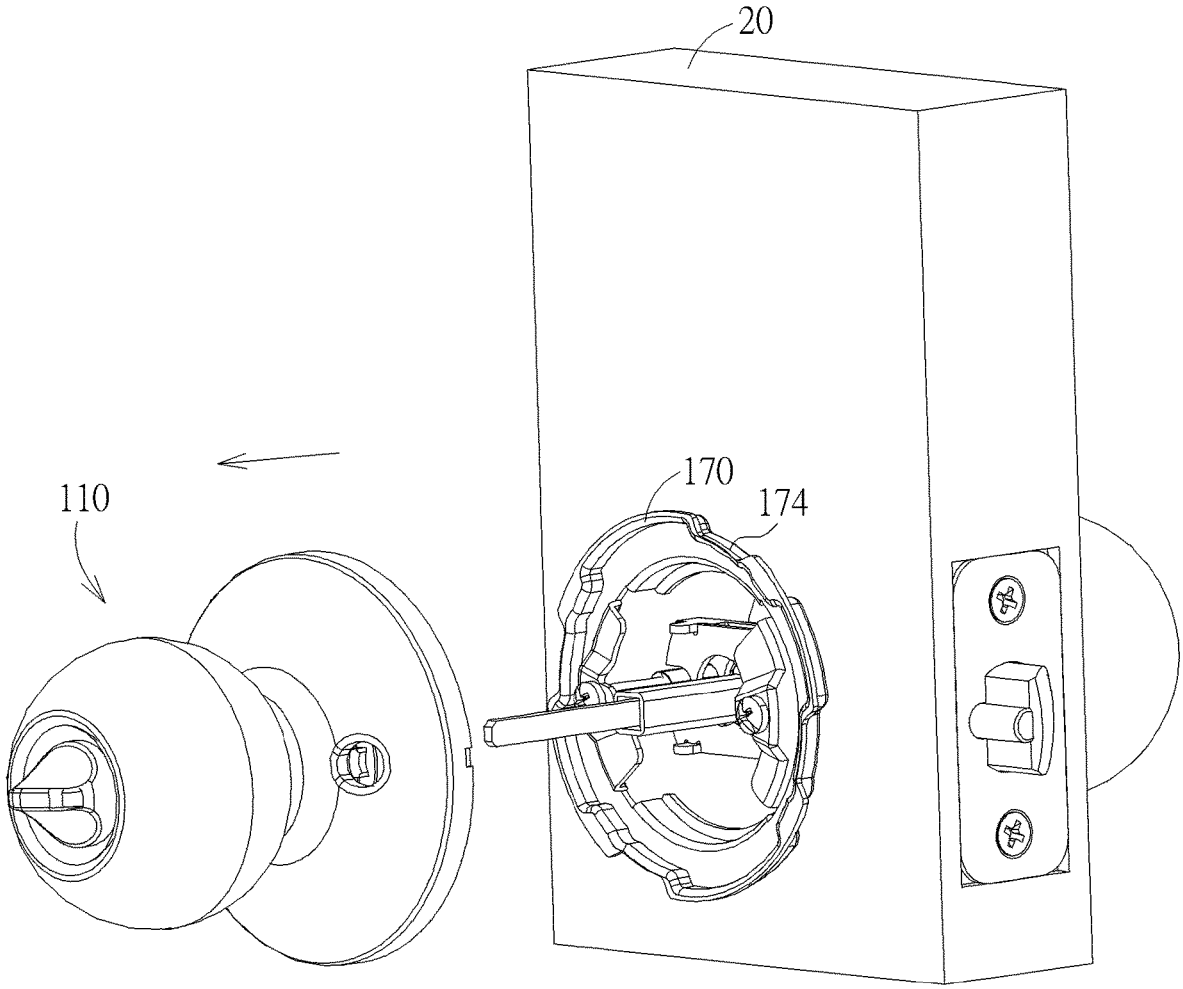
FIG. 26 is a schematic view illustrating Step 420.

In Step 420, the first handle set 110 is moved away from the door 20 such that the first handle set 110 is dismounted from the door 20. As shown in FIG. 26 and FIG. 2, after Step 410, the engaging structure 143 and the locking slot structure 174 are no longer in the engagement state. Therefore, the first handle set 110 is not fixed on the mounting plate 170 any longer. When the first handle set 110 is moved away from the door 20 along the direction of the arrow shown in FIG. 26, the elastic protruding portion 143*a* is brought to move away from the entrance portion 175, such that the first handle set 110 is dismounted from the door 20.

Afterwards, the fastening member 100 can be unfastened such that the mounting plate 170 is not fixed on the door 20. Then the mounting plate 170 is moved away from the door 20 to dismount the mounting plate 170 from the door 20. Moreover, the second handle set 190 can be moved away from the door 20 to dismount the second handle set 190 from the door 20. Furthermore, the screws 181 can be unfastened, and the latch mechanism 180 can be removed, such that the lock 10 is completely dismounted from the door 20.

According to the aforementioned embodiment, by using a tool to act on the indentation to drive the cover plate to rotate relative to the mounting plate, the engaging structure can be disengaged from the locking slot structure, thereby the first handle set can be dismounted from the door. Therefore, it is easy to dismount the lock by using the method 400 of the present disclosure.

Figure 28:
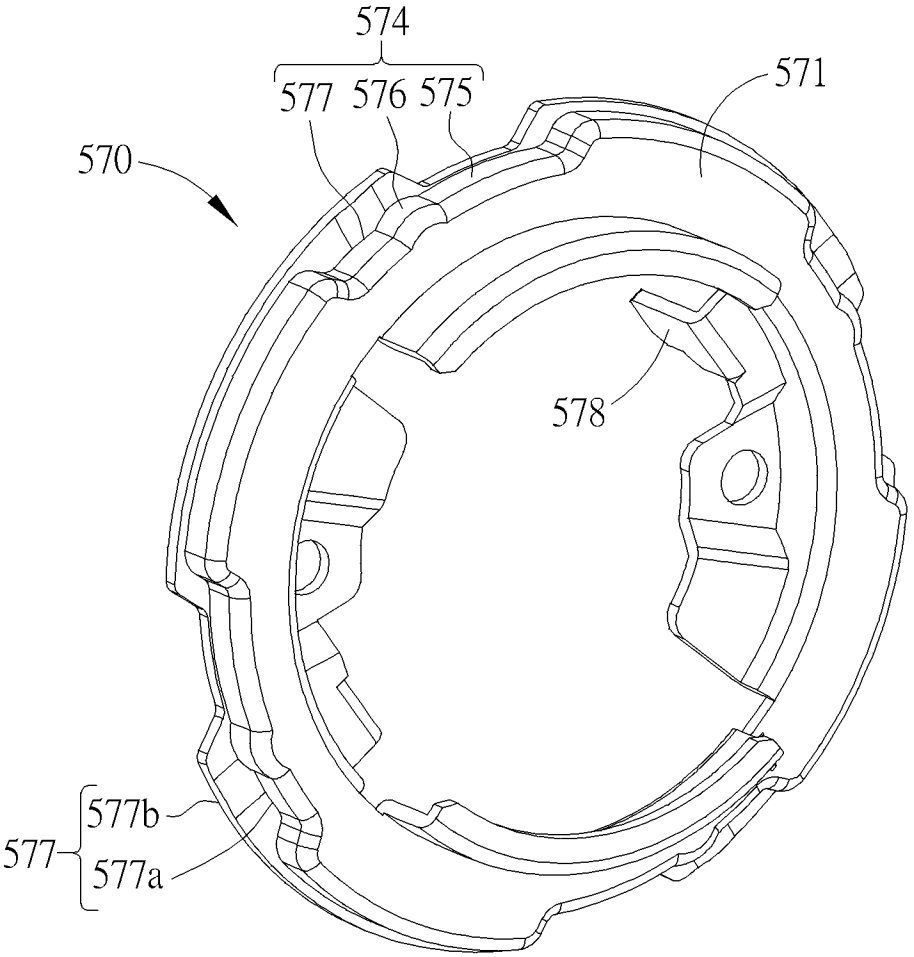
FIG. 28 is another three-dimensional diagram showing the mounting plate of FIG. 27.
Figure 27:
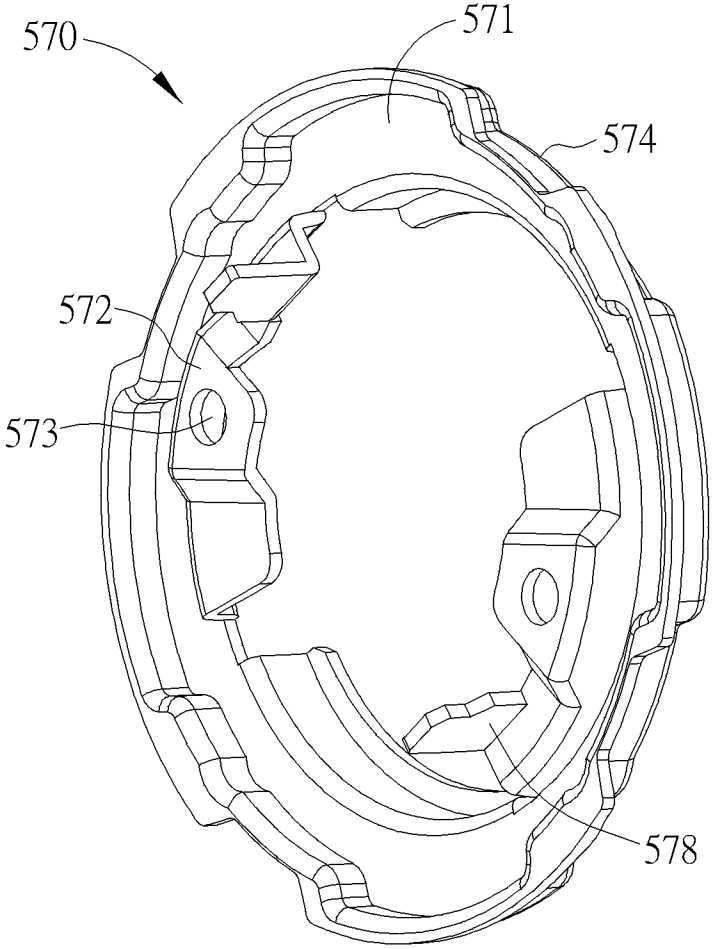
FIG. 27 is a three-dimensional diagram showing a mounting plate according to yet another embodiment of the present disclosure.
Figure 30:
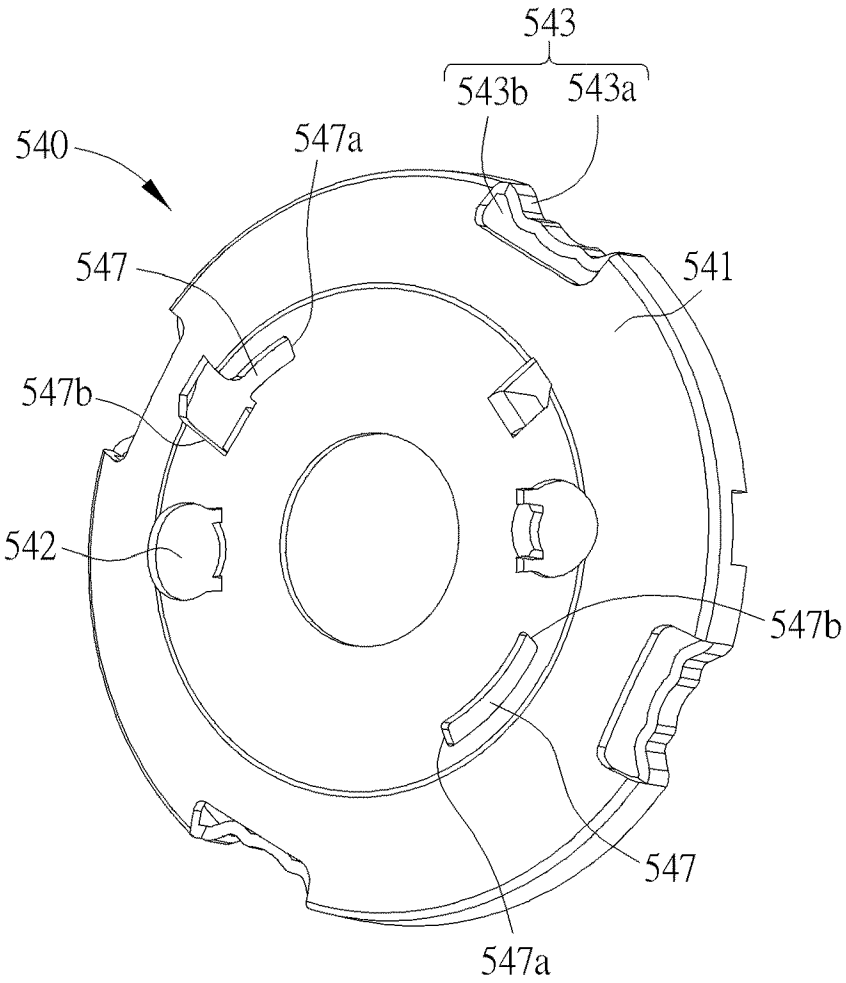
FIG. 30 is another three-dimensional diagram showing the cover plate of FIG. 29.
Figure 29:
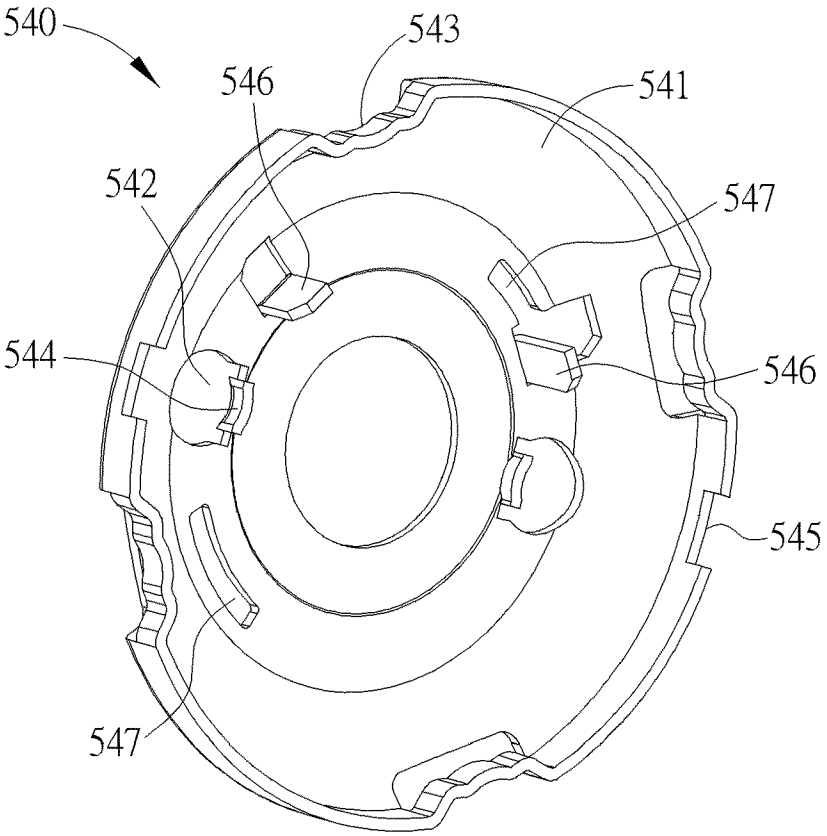
FIG. 29 is a three-dimensional diagram showing a cover plate corresponding to the mounting plate of FIG. 27.

Please refer to FIG. 27 to FIG. 30. FIG. 27 is a three-dimensional diagram showing a mounting plate 570 according to yet another embodiment of the present disclosure. FIG. 28 is another three-dimensional diagram showing the mounting plate 570 of FIG. 27. FIG. 29 is a three-dimensional diagram showing a cover plate 540 corresponding to the mounting plate 570 of FIG. 27. FIG. 30 is another three-dimensional diagram showing the cover plate 540 of FIG. 29. Specifically, the mounting plate 170 and the cover plate 140 of the lock 10 in FIG. 1 to FIG. 15 can be replaced by the mounting plate 570 and the cover plate 540. Other elements mentioned below can be the same as the elements having the same name in the lock 10 of FIG. 1 to FIG. 15 when no contradiction is found.

As shown in FIG. 27 and FIG. 28, the mounting plate 570 includes a mounting plate body 571, two protruding lugs 572 and two guiding posts 578. The two protruding lugs 572 are connected to the mounting plate body 571, and are protruded from the mounting plate body 571 toward the first handle set along a rotating axis. Each of the protruding lugs 572 includes a fastening hole 573. Each of the guiding posts 578 is extended and protruded from the mounting plate body 571. The mounting plate body 571 includes four locking slot structures 574. The locking slot structures 574 are disposed at a periphery of the mounting plate body 571. Each of the locking slot structures 574 includes an entrance portion 575, a raised portion 576 and a holding portion 577 connected with each other. The holding portion 577 includes a notch 577*a* and a baffle 577*b*. Other details of the mounting plate 570 can be the same as that of the mounting plate 170 when no contradiction is found.

As shown in FIG. 29 and FIG. 30, the cover plate 540 includes a cover plate body 541, two second abutting features and two limiting posts 546. In the embodiment, the second abutting feature is the obstruction post 544 extended and protruded from the cover plate body 541, but the present disclosure is not limited thereto. The limiting post 546 is extended and protruded from the cover plate body 541 for limiting a position of the restoring element. The cover plate body 541 includes two penetrating holes 542, four engaging structures 543, two indentations 545 and two guiding slots 547. In the embodiment, the shapes of the two guiding slots 547 are different. However, the present disclosure is not limited thereto. In other embodiment, the shapes of the two guiding slots 547 can be the same. The engaging structures 543 are corresponding to the locking slot structures 574 of the mounting plate 570. The engaging structures 543 are disposed at a periphery of the cover plate body 541, and each of the engaging structures 543 includes an elastic protruding portion 543*a* and an opening structure 543*b*. In the embodiment, an included angle θ (shown in FIG. 8) between two engaging structures 543 adjacent to each other is 90 degrees. As such, the four engaging structures 543 are disposed symmetrically, which is favorable for enhancing the engaging stability. The guiding slot 547 is corresponding to the guiding post 578, and the guiding post 578 is slidably disposed in the guiding slot 547. The guiding slot 547 has a first end 547*a* and a second end 547*b*. When the elastic protruding portion 543*a* is located at the entrance portion 575, the guiding post 578 is located at the first end 547*a*. When the elastic protruding portion 543*a* is located at the holding portion 577, the guiding post 578 is located at the second end 547*b*. As such, the guiding slot 547 can provide the position-limiting function, which is favorable for the alignment between the mounting plate 570 and the cover plate 540. Furthermore, when the cover plate 540 is brought to rotate by the driving plate to engage with the engaging structure 543 with the locking slot structure 574, the disengagement of the engaging structure 543 and the locking slot structure 574 caused by the elastic protruding portion 543*a* separated from the holding portion 577 due to excessive rotation of the cover plate 540 can be prevented. Other details of the cover plate 540 can be the same as that of the cover plate 140 when no contradiction is found, and are not recited herein.

Figure 31:
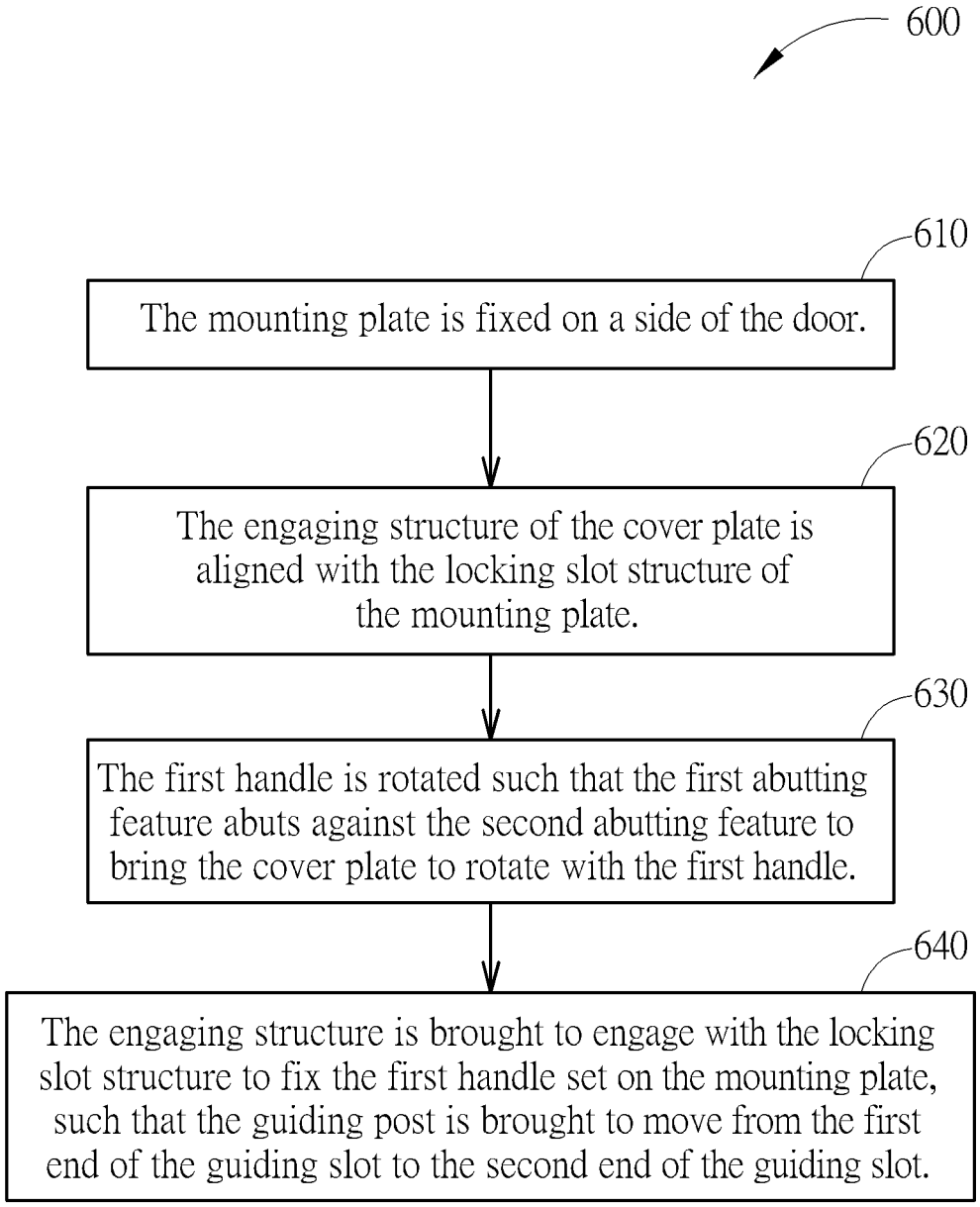
FIG. 31 is a flow chart of a method for mounting a lock on a door according to yet another embodiment of the present disclosure.

FIG. 31 is a flow chart of a method 600 for mounting a lock on a door according to yet another embodiment of the present disclosure. The method 600 includes Step 610, Step 620, Step 630 and Step 640. The lock adaptable for the method 600 includes a mounting plate and a first handle set. The mounting plate includes a locking slot structure and a guiding post. The first handle set includes a cover plate, a first handle and a first abutting structure. The cover plate includes an engaging structure, a second abutting structure and a guiding slot. The first handle is rotatably connected to the cover plate. The first abutting feature is connected to the first handle in a manner that the first abutting feature is moved synchronously with the first handle. The method 600 can be used to mount a lock including the mounting plate 570 of FIG. 27 and FIG. 28 and the cover plate 540 of FIG. 29 and FIG. 30 on the door 20. For specific explanation, herein the lock 10 including the mounting plate 570 of FIG. 27 and FIG. 28 and the cover plate 540 of FIG. 29 and FIG. 30 and the door 20 are used as the example. However, the lock adaptable for the method 600 is not limited thereto. Furthermore, details of other elements can refer to the elements having the same name in the lock 10.

In Step 610, the mounting plate 570 is fixed on a side 21 of the door 20, which can refer to Step 210 and is not repeated herein.

In Step 620, the engaging structure 543 of the cover plate 540 is aligned with the locking slot structure 574 of the mounting plate 570. By this time, the guiding post 578 is located at the first end 547*a* of the guiding slot 547. Other details of Step 620 can refer to Step 220 and is not repeated herein.

In Step 630, the first handle is rotated such that the first abutting feature abuts against the second abutting feature to bring the cover plate 540 to rotate with the first handle, which can refer to Step 230 and is not repeated herein.

In Step 640, the engaging structure 543 is brought to engage with the locking slot structure 574 to fix the first handle set on the mounting plate 570, such that the guiding post 578 is brought to move from the first end 547*a* of the guiding slot 547 to the second end 547*b* of the guiding slot 547. Specifically, when the elastic protruding portion 543*a* of the engaging structure 543 of the cover plate 540 is brought to enter into the holding portion 577 from the entrance portion 575 via slidably passing the raised portion 576, the guiding post 578 moves from the first end 547*a* of the guiding slot 547 to the second end 547*b* of the guiding slot 547.

Other details of the method 600 can be the same as that of the method 200 when no contradiction is found, and are not recited herein.

Figure 32:
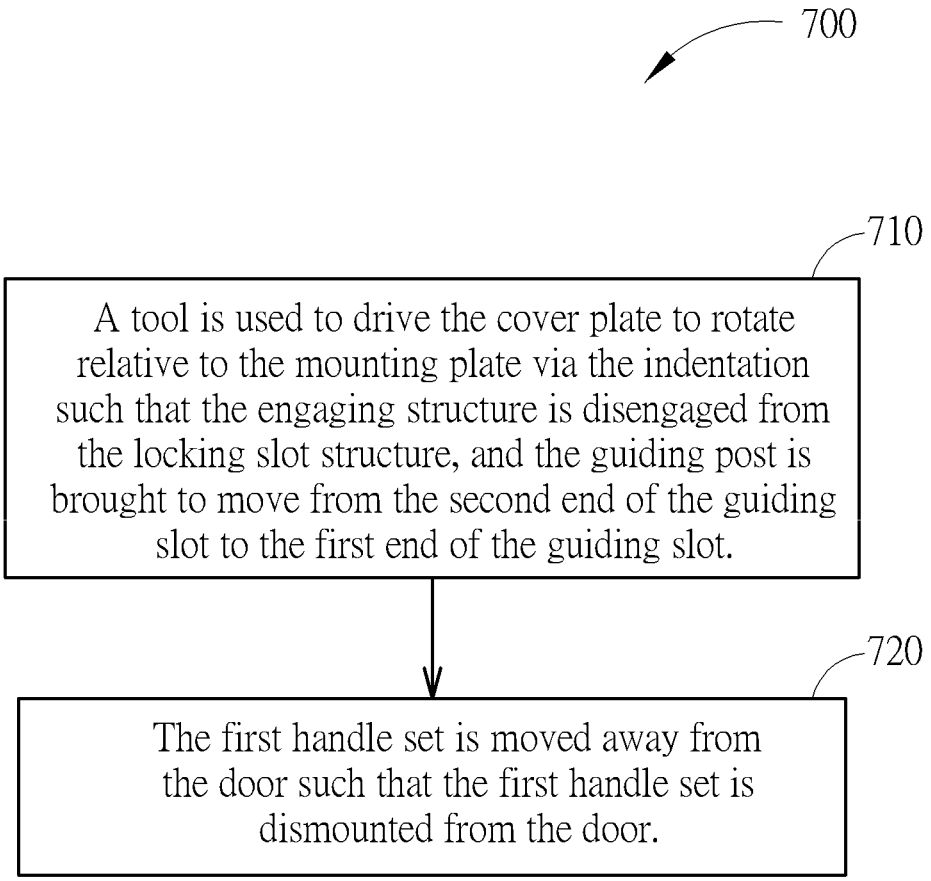
FIG. 32 is a flow chart of a method for dismounting a lock from a door according to yet another embodiment of the present disclosure.

FIG. 32 is a flow chart of a method 700 for dismounting a lock from a door according to yet another embodiment of the present disclosure. The method 700 includes Step 710 and Step 720. The lock adaptable for the method 700 includes a mounting plate and a first handle set. The mounting plate is fixed on a side of the door and includes a locking slot structure and a guiding post. The first handle set includes a cover plate. The cover plate includes an engaging structure, an indentation and a guiding slot. The engaging structure is engaged with the locking slot structure to fix the first handle set on the mounting plate. The indentation is disposed at a periphery of the cover plate and exposed to an outside. The method 700 can be used to dismount a lock including the mounting plate 570 of FIG. 27 and FIG. 28 and the cover plate 540 of FIG. 29 and FIG. 30 from the door 20. For specific explanation, herein the lock including the mounting plate 570 of FIG. 27 and FIG. 28 and the cover plate 540 of FIG. 29 and FIG. 30 and the door 20 are used as the example. However, the lock adaptable for the method 700 is not limited thereto. Furthermore, details of other elements can refer to the elements having the same name in the lock 10.

In Step 710, a tool is used to drive the cover plate 540 to rotate relative to the mounting plate 570 via the indentation 545 such that the engaging structure 543 is disengaged from the locking slot structure 574, and the guiding post 578 is brought to move from the second end 547*b* of the guiding slot 547 to the first end 547*a* of the guiding slot 547. Other details of Step 710 can be the same as that of Step 410, and are not recited herein.

In Step 720, the first handle set is moved away from the door 20 such that the first handle set is dismounted from the door 20. Other details of Step 720 can be the same as that of Step 420, and are not recited herein.

Other details of the method 700 can be the same as that of the method 400 when no contradiction is found, and are not recited herein.

Furthermore, the lock including the mounting plate 570 of FIG. 27 and FIG. 28 and the cover plate 540 of FIG. 29 and FIG. 30 can also be dismounted from the door 20 by the method 300, details thereof are not recited herein.

According to the lock of the aforementioned embodiment, the lock has round handles (i.e., the first handle and the second handle are round or approximately round), which is only for exemplary and the present disclosure is not limited thereto. The first handle and the second handle can be formed in other shapes. For example, the first handle and the second handle can be formed as blade handle (also called as flat handle).

According to the lock of the aforementioned embodiment, the number of the fastening members is two, and the numbers of the openings, penetrating holes, protruding lugs, fastening holes and screw posts are all corresponding to the number of the fastening members. However, the present disclosure is not limited thereto. The number of the fastening members can be adjusted according to practical demands, and the numbers of the openings, penetrating holes, protruding lugs, fastening holes and screw posts can be adjusted accordingly. For example, the number of the fastening member can be one, which also can achieve the effect to fix the mounting plate on the door.

According to the lock of the aforementioned embodiment, the number of the indentations is two, and the number of the side slots is corresponding to the number of the indentations. However, the present disclosure is not limited thereto. The number of the indentations can be adjusted according to practical demands, and the number of the side slots can be adjusted accordingly. For example, the number of the indentation can be one, which also can achieve the effect of rotating the cover plate relative to the mounting plate via the indentation to disengage the engaging structure from the locking slot structure.

According to the lock of the aforementioned embodiment, the number of the engaging structures is four, and the number of the locking slot structures is corresponding to the number of the engaging structures. However, the present disclosure is not limited thereto. The number of the engaging structures can be adjusted according to practical demands, and the number of the locking slot structures can be adjusted accordingly. For example, the number of the engaging structure can be one, which also can achieve the effect of engaging the engaging structure with the locking slot structure to fix the first handle set on the mounting plate.

According to the lock of the aforementioned embodiment, the number of the obstruction posts is two. However, the present disclosure is not limited thereto. The number of the obstruction post can be one, which also can achieve the effect of abutting the first protruding tab with the obstruction post to rotate the driving plate and bring the cover plate to rotate with the driving plate.

According to the present disclosure, the term "first" or "second" is only for naming, and has no special meanings, such as order or quality.

Compared to the prior art, the lock of the present disclosure has advantages as follows. With the dimension of the opening of the decoration cover being greater than the maximum radial dimension of the fastening member, the fastening member can be unfastened directly via the opening of the decoration cover by using a tool. As such, the first handle set and the mounting plate can be dismounted from the door and does not require removing the decoration cover before unfastening the fastening member. Therefore, it is easy to dismount the lock of the present disclosure. With the arrangement of the engaging structure and the locking slot structure, the first handle set and second handle set are not directly fixed and connected by screws. Accordingly, it does not need to hold the first handle set and second handle set and operate a screwdriver to screw the screws at the same time. Therefore, it is easy to mount the lock of the present disclosure.

According to the method for dismounting the lock from the door of the present disclosure, the fastening member can be unfastened directly via the opening of the decoration cover by using a tool. As such, the first handle set and the mounting plate can be dismounted from the door and does not require removing the decoration cover before unfastening the fastening member. Therefore, it is easy to dismount the lock by using the method of the present disclosure.

According to the method for mounting the lock on the door of the present disclosure, the engaging structure can be brought to engage with the locking slot structure by rotating the first handle. As such, the first handle set and second handle set are not directly fixed and connected by screws. Accordingly, it does not need to hold the first handle set and second handle set and operate a screwdriver to screw the screws at the same time. Therefore, it is easy to mount the lock by using the method of the present disclosure.

According to the method for dismounting the lock from the door of the present disclosure, the engaging structure can be disengaged from the locking slot structure by using a tool to drive the cover plate to rotate relative to the mounting plate via the indentation, such that the first handle set can be dismounted from the door. Therefore, it is easy to dismount the lock by using the method of the present disclosure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for dismounting a lock from a door, the lock comprising a mounting plate and a first handle set, the mounting plate being fixed on a side of the door and comprising a locking slot structure, the first handle set comprising a decoration cover and a cover plate, the decoration cover comprising a side slot, the cover plate being disposed between the decoration cover and the mounting plate, the cover plate comprising an engaging structure and an indentation, the engaging structure being engaged with the locking slot structure to fix the first handle set on the mounting plate, the indentation being disposed at a periphery of the cover plate, the indentation corresponding to the side slot and exposed to an outside through the side slot, the method comprising:

using a tool to drive the cover plate to rotate relative to the mounting plate via the indentation such that the engaging structure is disengaged from the locking slot structure; and moving the first handle set away from the door such that the first handle set is dismounted from the door.

2. The method of claim 1, wherein the mounting plate further comprises a guiding post, the cover plate further comprises a guiding slot, to drive the cover plate to rotate relative to the mounting plate via the indentation such that the engaging structure is disengaged from the locking slot structure comprises:

bringing the guiding post to move from a second end of the guiding slot to a first end of the guiding slot.

3. The method of claim 1, wherein the locking slot structure comprises an entrance portion, a raised portion and a holding portion connected with each other, the entrance portion, the raised portion and the holding portion are arranged along a direction perpendicular to a rotating axis defined by the lock, the engaging structure comprises an elastic protruding portion, the elastic protruding portion is held by the holding portion such that the engaging structure is engaged with the locking slot structure, to drive the cover plate to rotate relative to the mounting plate via the indentation such that the engaging structure is disengaged from the locking slot structure comprises:

bringing the elastic protruding portion to move to the entrance portion from the holding portion via slidably passing the raised portion.

4. The method of claim 3, wherein moving the first handle set away from the door comprises:

bringing the elastic protruding portion to move away from the entrance portion.

5. The method of claim 1, wherein the lock further comprises a fastening member, the mounting plate further comprises a mounting plate body and a protruding lug, the protruding lug is extended inwardly from the mounting plate body, the protruding lug comprises a fastening hole, the fastening member is inserted through the fastening hole of the protruding lug to fix the mounting plate on the door, the method further comprises:

unfastening the fastening member; and moving the mounting plate away from the door to dismount the mounting plate from the door.

6. The method of claim 5, wherein the lock further comprises a second handle set disposed on another side of the door, the second handle set comprises a screw post corresponding to the fastening hole, the fastening member is inserted through the fastening hole of the protruding lug then fastened into the screw post, the method further comprises:

moving the second handle set away from the door such that the second handle set is dismounted from the door.

* * * * *